US011255521B1

(12) United States Patent
McCane et al.

(10) Patent No.: US 11,255,521 B1
(45) Date of Patent: Feb. 22, 2022

(54) LINEAR LIGHT FIXTURE

(71) Applicant: ABL IP Holding LLC, Atlanta, GA (US)

(72) Inventors: Stephen B. McCane, McDonough, GA (US); Charles Albo, Atlanta, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 17/109,312

(22) Filed: Dec. 2, 2020

(51) Int. Cl.

| | |
|---|---|
| ***F21K 9/272*** | (2016.01) |
| ***F21Y 103/10*** | (2016.01) |
| ***F21V 21/005*** | (2006.01) |
| *F21Y 115/10* | (2016.01) |

(52) U.S. Cl.
CPC ..... *F21V 21/005* (2013.01); *F21K 9/272* (2016.08); *F21Y 2103/10* (2016.08); *F21Y 2115/10* (2016.08)

(58) Field of Classification Search
CPC ..... F21K 9/272; F21V 21/005
See application file for complete search history.

(56) References Cited

U.S. PATENT DOCUMENTS

| | | | | |
|---|---|---|---|---|
| 5,628,557 | A * | 5/1997 | Huang | F21S 2/00 362/125 |
| 6,659,628 | B2 * | 12/2003 | Gomez Del Campo | F21V 21/005 362/219 |
| 8,454,193 | B2 * | 6/2013 | Simon | F21K 9/272 362/217.17 |
| 10,072,827 | B2 * | 9/2018 | Clark | F21S 2/005 |
| 10,352,510 | B2 * | 7/2019 | Van Winkle | F21S 4/10 |
| 10,520,447 | B2 * | 12/2019 | Nichols | G01N 21/8803 |
| 10,584,860 | B2 * | 3/2020 | Dungan | F21S 2/005 |
| 11,015,776 | B2 * | 5/2021 | Gomez Martinez | F21V 23/006 |
| 2002/0001191 | A1 * | 1/2002 | Grierson | F21V 21/005 362/219 |
| 2004/0256000 | A1 * | 12/2004 | Konstantin | E06B 9/24 136/251 |
| 2011/0310604 | A1 * | 12/2011 | Shimizu | F21K 9/27 362/235 |
| 2013/0286637 | A1 * | 10/2013 | Lay | F21V 7/0008 362/147 |

* cited by examiner

*Primary Examiner* — Leah Simone Macchiarolo
(74) *Attorney, Agent, or Firm* — Kilpatrick Townsend & Stockton LLP

(57) ABSTRACT

An alignment system for a linear light fixture includes multiple light elements. Each light element includes a top surface that defines a top channel. Each light element includes an endcap that defines apertures that extend through an entire thickness of the endcap. A top surface of each endcap defines an endcap channel. A hanger insert is positionable between the endcaps of two light elements. The hanger insert defines additional apertures. A top surface of the hanger insert defines an insert channel and a hanger connection. The top channels, the endcap channels, and the insert channel form an elongate channel. The system includes pins that are configured to extend through the apertures of the endcaps and the hanger insert. The system includes a connector plate that is configured to be received and secured within the elongate channel. The connector plate defines a central aperture that provides access to the hanger connection.

20 Claims, 23 Drawing Sheets

LINEAR LIGHT FIXTURE

BACKGROUND OF THE INVENTION

Conventional lighting solutions often employ linear lighting fixtures that are formed from a number of elongate light elements that are coupled together end to end. During installation of such linear lighting fixtures, it is oftentimes difficult to get adjacent light elements to be perfectly aligned. Any misalignment becomes more readily apparent in longer fixtures, as the misalignment of the various elements compounds and results in a noticeably crooked fixture. Additionally, such linear lighting systems are often difficult to maintain, as there is often no simple way to remove a single troublesome light element. Therefore, improvements in the areas of alignment and maintenance of linear light fixtures are desired.

BRIEF SUMMARY OF THE INVENTION

Embodiments of the present invention are directed to connections systems for linear lighting fixtures that allow the fixtures to be assembled and installed quickly and easily. Embodiments enable any number of discrete light elements to be connected together end to end in a perfectly linear arrangement. Embodiments of the present invention further enable discrete light elements to be removed and/or replaced while allowing the rest of the light elements of the linear light fixture to remain suspended from a ceiling or other structure. This provides convenient maintenance solutions, as only those light elements that need to be serviced need to be disconnected and/or removed from the ceiling, while repaired and/or new light elements may be readily inserted within an existing light fixture.

In one particular embodiment, an alignment system for a linear light fixture is provided. The alignment system may include a first light element having a first top surface that defines a first top channel. The first light element may include a first endcap that defines a first number of apertures that extend through an entire thickness of the first endcap. A top surface of the first endcap may define a first endcap channel. The system may include a second light element having a second top surface that defines a second top channel. The second light element may include a second endcap that defines a second number of apertures that extend through an entire thickness of the second endcap. A top surface of the second endcap may define a second endcap channel. The system may also include a hanger insert that is configured to be positioned between the first endcap and the second endcap. The hanger insert may define a third number of apertures. A top surface of the hanger insert may define a hanger insert channel and a hanger connection. The first channel, the first endcap channel, the second channel, the second endcap channel, and the hanger insert channel may form an elongate channel. The system may include a plurality of pins that are configured to extend through the first number of apertures, the second number of apertures, and the third number of apertures. The system may further include a connector plate that is configured to be received and secured within the elongate channel. The connector plate may define a central aperture that is configured to provide access to the hanger connection.

In some embodiments, a face of each of the first endcap and the second endcap may include a first alignment feature. Each face of the hanger insert may include a second alignment feature. The first alignment features may be configured to engage with the second alignment features. In some embodiments, the first alignment features may include protrusions that extend outward from the major face of each of the first endcap and the second endcap. The second alignment features may include recesses formed within the major faces of the hanger insert. In some embodiments, the connector plate has a width that substantially matches a width of the channel. In some embodiments, each of the plurality of pins may include at least one protrusion that extends outward from an outer surface of the pin to limit an insertion depth of the pin within one of the first number of apertures or one of the second number of apertures. In some embodiments, the first top channel and the second top channel may each define at least one longitudinal slot. A bottom surface of the connector plate may include at least one fin. The at least one fin may be insertable within the at least one longitudinal slot to align the first light element and the second light element and prevent the first light element and the second light element from sliding apart. In some embodiments, the hanger connection may include a threaded receptacle that is configured to interface with a corresponding threaded connector of a hanging mechanism to secure the first light element and the second light element to an overhead structure.

In some embodiments, the connector plate may be secured within the elongate channel using a plurality of fasteners. In some embodiments, the plurality of fasteners may include self-threading screws. The first housing channel and the second housing channel may each define at least one longitudinal slot. The plurality of fasteners may be configured to engage with the at least one longitudinal slot. In some embodiments, the connector plate may further define a slot that extends from the central aperture through a peripheral edge of the connector plate. Each of the number of apertures may have a non-circular cross-section. In some embodiments, the hanger connection may include a protrusion that extends upward from a bottom surface of the hanger insert channel. The central aperture of the connector plate may be configured to receive the protrusion.

In another embodiment, a method of installing a linear light fixture is provided. The method may include positioning a hanger insert adjacent to a first endcap of a first light element such that a first aperture defined by the first endcap is aligned with a second aperture defined by the hanger insert. The method may also include inserting a pin through the first aperture and the second aperture and positioning a second endcap of a second light element adjacent to the hanger insert on a side opposite of the first endcap such that a third aperture defined by the second endcap receives an end of the pin. The method may further include securing a hanging mechanism to a hanger connection positioned on a top surface of the hanger insert and securing a connector plate within a channel formed within the top surfaces of the first light element, the first endcap, the hanger insert, the second endcap, and the second light element.

In some embodiments, positioning the hanger insert adjacent to the first endcap may include engaging an alignment feature of the first endcap with a corresponding alignment feature of the hanger insert. In some embodiments, the method may also include inserting a portion of the hanging mechanism through a slot formed in the connector plate to align a central aperture of the connector plate with the hanger connection prior to securing the connector plate within the channel. In some embodiments, securing the connector plate within the channel may include positioning the central aperture of the connector plate around the hanger connection. Securing the hanging mechanism to the hanger connection may include engaging a threaded connector of the hanging mechanism with a corresponding threaded feature of the hanger connection. Securing the connector plate within the channel may include inserting a plurality of fasteners into the connector plate and the channel.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention are directed to systems and methods for assembling linear light fixtures and mounting the fixtures to a ceiling or other overhead structure. The systems and methods described herein may be used to secure any number of elongate light elements together to form and properly align a linear light fixture. Embodiments utilize a combination self-aligning coupling components that align and secure adjacent light elements to one another as well as mount the resulting linear light fixture to a ceiling or other overhead structure. Additionally, embodiments of the invention provide connections between adjacent light elements that enable individual light elements to be removed from the linear light fixture for service or replacement, while allowing the remaining light elements to remain suspended from the ceiling. This allows individual light elements to be easily serviced or replaced, without the need to unmount or disassemble the rest of the linear light fixture.

Figure 1A:
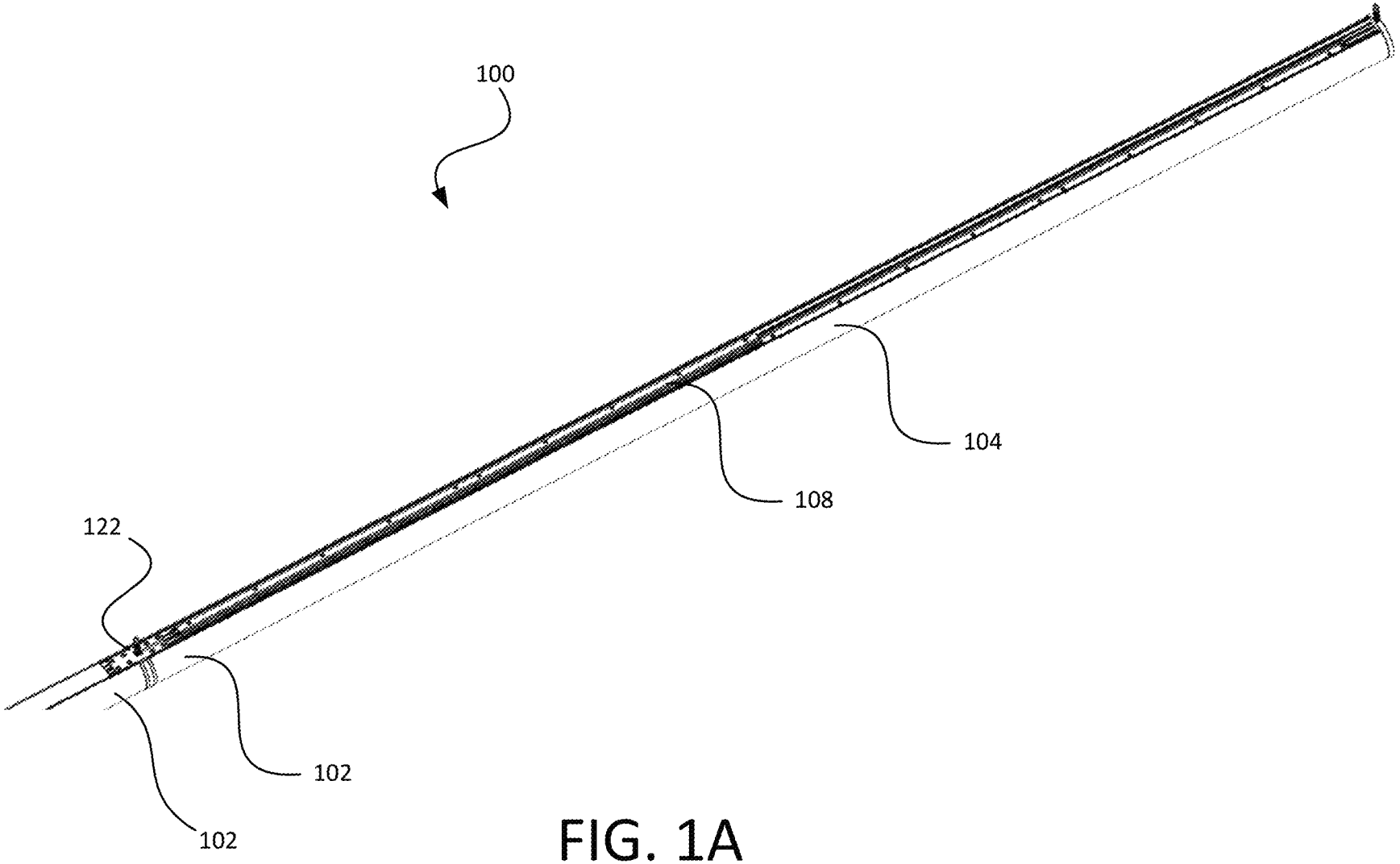
FIG. 1A illustrates a top perspective view of a linear light fixture according to embodiments.
Figure 1B:
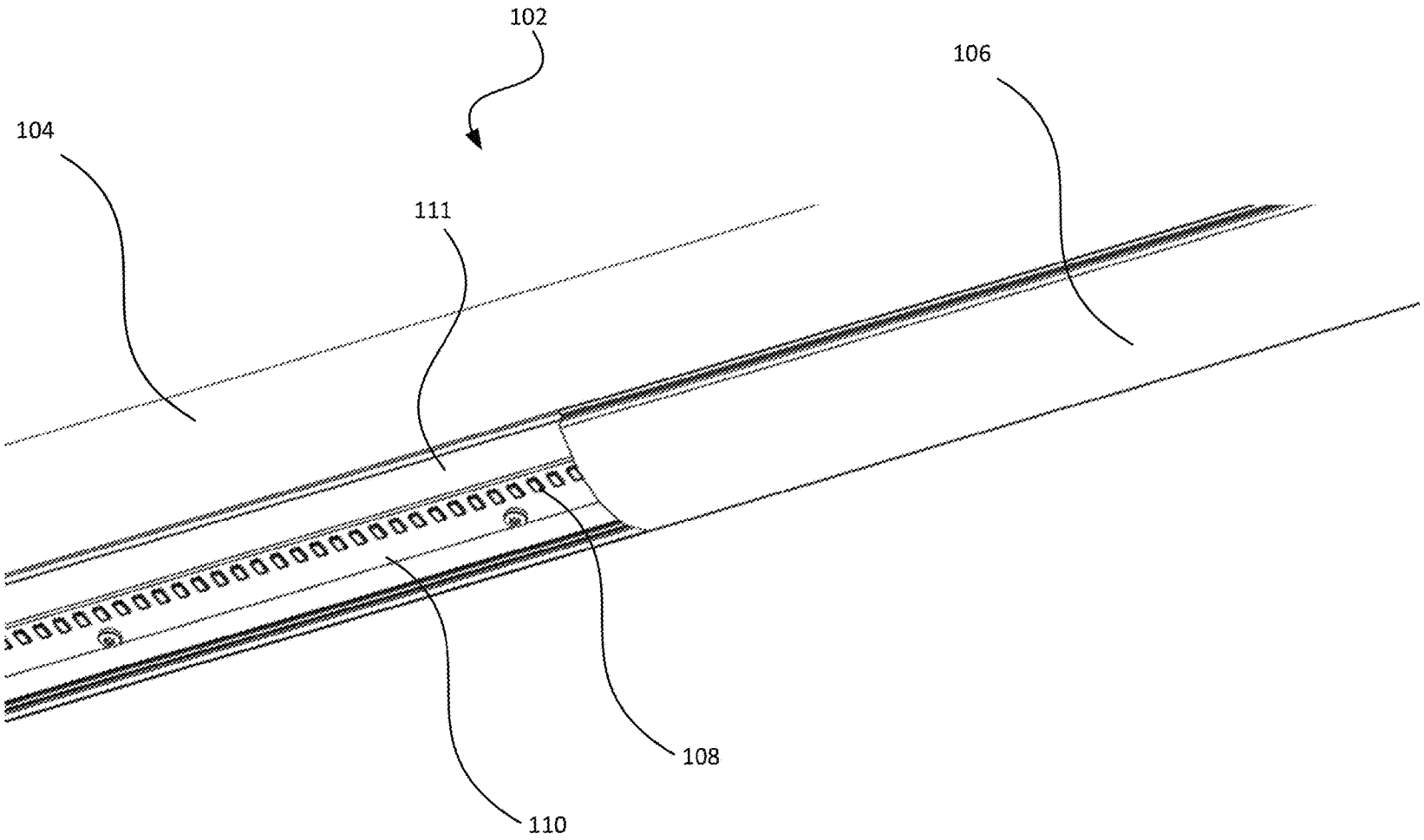
FIG. 1B illustrates a bottom perspective view of a portion of the linear light fixture of FIG. 1A.

Turning now to FIGS. 1A and 1B, a portion of a linear light fixture 100 is shown. As illustrated, the linear light fixture 100 is formed from two individual light elements 102 that have been coupled together end to end, although it will be appreciated that any number of light elements 102 may be coupled together to form linear light fixture 100. Typically, each light element 102 includes a housing 104 that stores the internal components of the light element 102. For example, a light engine and/or driver (not shown) may be positioned within the housing 104. The light engine and/or driver may be electrically coupled with at least one light source for emitting light from the light engine and/or driver through one or more outer lenses 106 and/or other optics. As best illustrated in FIG. 1B, the light source may be in the form of one or more light emitting diodes (LEDs) 108 mounted on a printed circuit board ("PCB") 110. The PCB 110 can be secured within the housing 104 in some embodiments. Each PCB 110 can have wiring for connecting to a power supply, which can be dedicated to a single PCB 110 or shared between a number of PCBs 110. The LEDs 108 may be single-die or multi-die LEDs, DC or AC, or can be organic light emitting diodes. White, color, and/or multicolor LEDs 108 may be used. Moreover, the LEDs 108 mounted on a PCB 110 need not all be the same color, size, or shape; rather, mixtures of different LEDs 108 may be used. Furthermore, in some embodiments no PCB is needed; rather, the LEDs 108 may be chip-on-board LEDs 108 provided within the light engine and/or driver. The LEDs 108 may be directed through a top and/or a bottom of the light element 102, with some embodiments including multiple sets of LEDs 108 (such as one projecting upwards and one projecting downwards). In such embodiments, each set of LEDs 108 may be covered by a lens 106 or other optic. In some embodiments that have LEDs 108 directed upward, LEDs 108 may be positioned atop the housing 104. In some embodiments, each light element 102 may include one or more reflectors 111 that help reflect and direct light from the LEDs 108 in a desired direction.

Figure 2A:
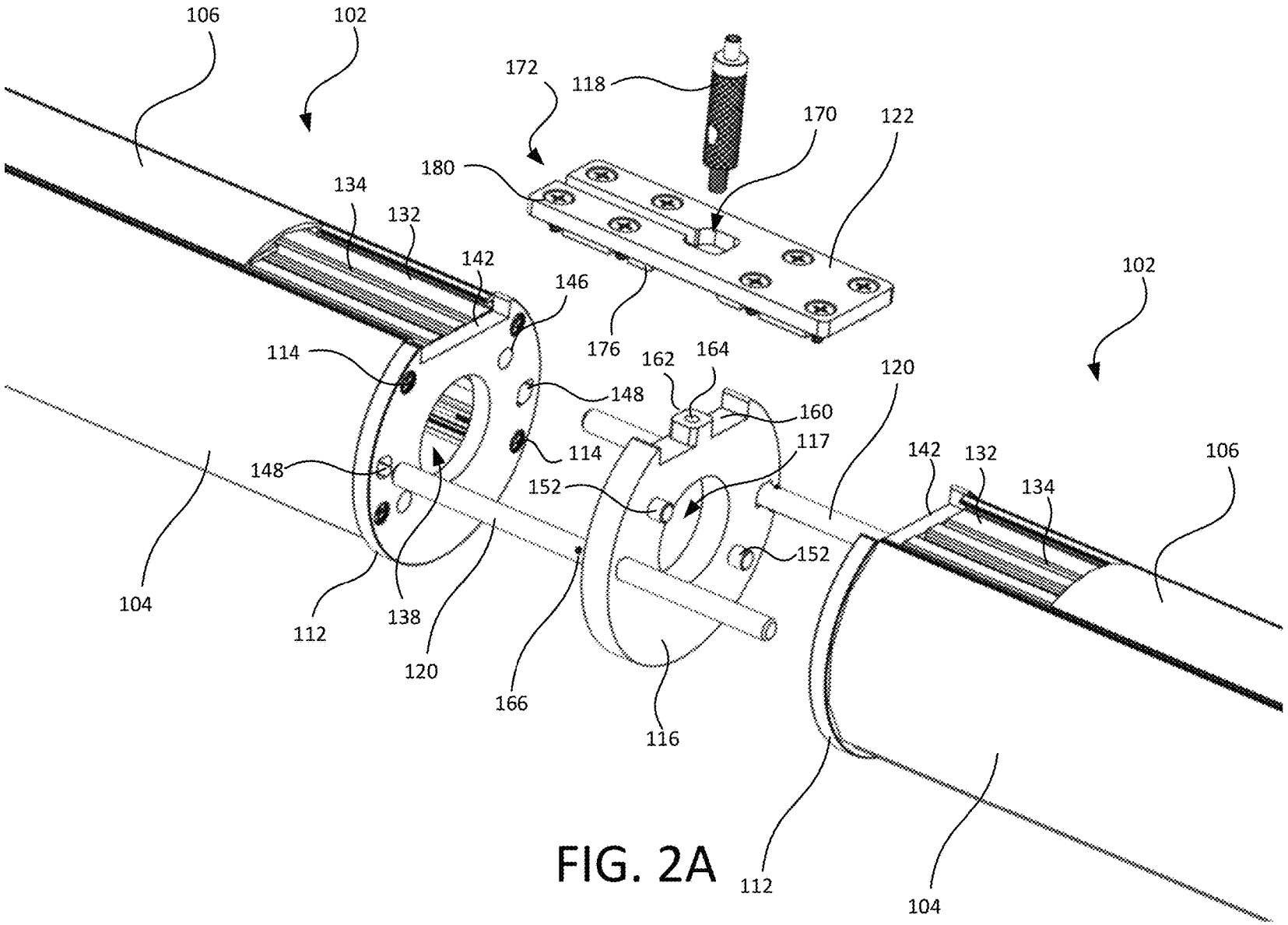
FIG. 2A is an exploded view of a connection between two light elements of the linear light fixture of FIG. 1A.
Figure 2B:
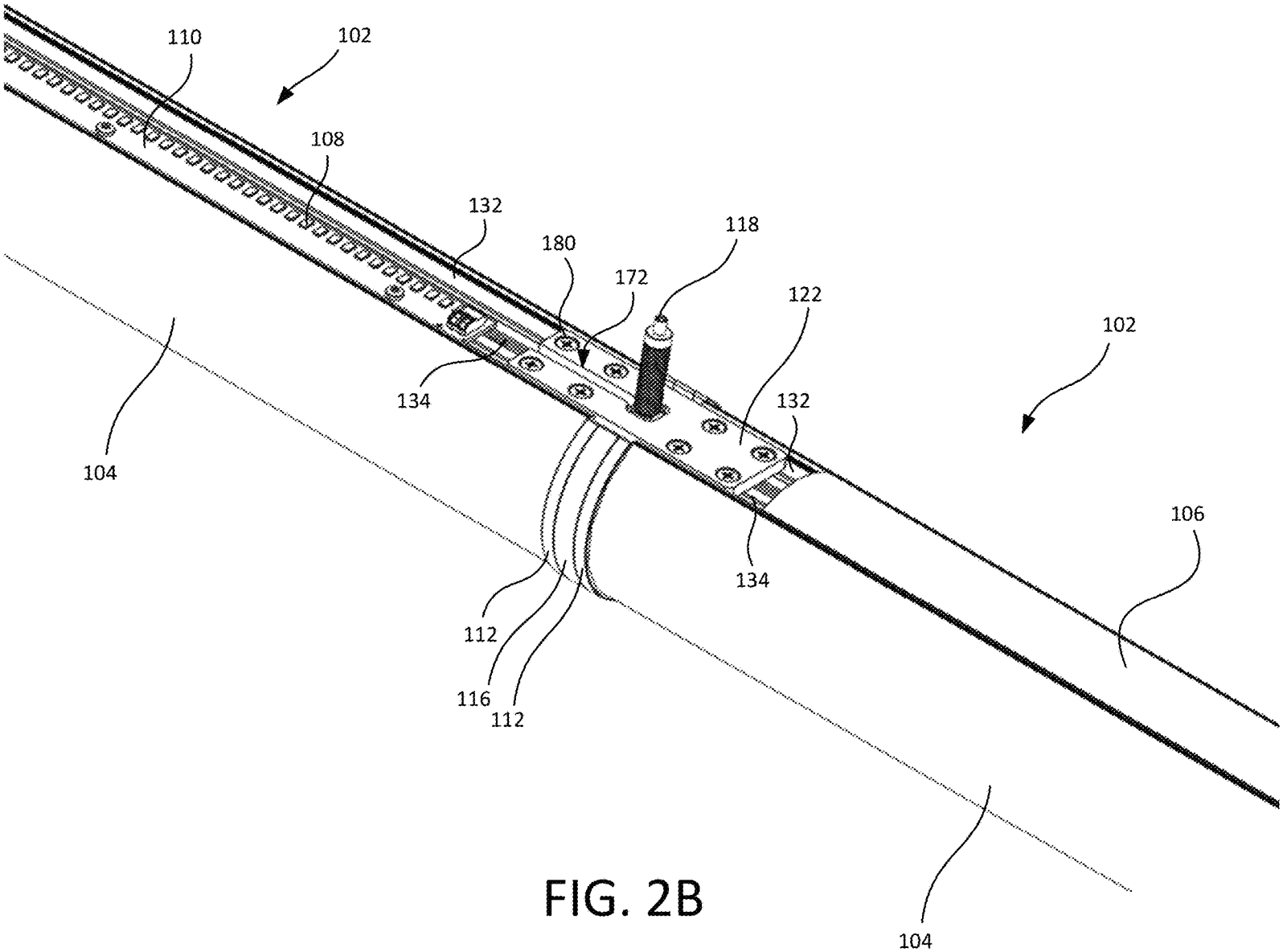
FIG. 2B is an assembled view of the connection between two light elements of FIG. 2A.

FIGS. 2A and 2B illustrate a connection formed between adjacent light elements 102. Oftentimes, these light elements 102 include uplight components, in addition to, or in combination with, downlight components. Here, each light element 102 includes an endcap 112 that is affixed to a distal end of the housing 104 of each light element 102. In some embodiments, the endcaps 112 may be formed integrally with the housing 104, however more typically the endcaps 112 are separately formed and later affixed to the housing 104, such as by using fasteners 114. A hanger insert 116 is positioned between endcaps 112 of adjacent light elements 102. The hanger insert performs two primary functions: to help properly align the adjacent light elements 102 and to provide an attachment site for a hanging mechanism 118 to secure the light fixture 100 to a ceiling or other overhead structure. A number of alignment pins 120 are provided that are used to align the adjacent light elements 102 together and to support the adjacent light elements 102 in a vertical direction when the light fixture 100 is hung or otherwise suspended from a ceiling or other overhead structure. To fix positions of the adjacent light elements 102 relative to one another in a horizontal direction, light fixture 100 includes a connector plate 122 that is secured to a top of each of the adjacent light elements 102 and prevents the adjacent light elements 102 from sliding apart from one another. FIG. 2B shows the assembled connection between the adjacent light elements 102, with a hanging mechanism 118 extending through connector plate 122 and secured to the hanger insert 116. As noted above, any number of such connections may be formed to secure any number of light elements 102, with each connection providing an attachment point for hanging the linear light fixture 100 from a ceiling. While not described in detail, in some embodiments extreme ends of the light fixture 100 may include different endcaps that include additional attachment points for hanging mechanisms.

Figure 3A:
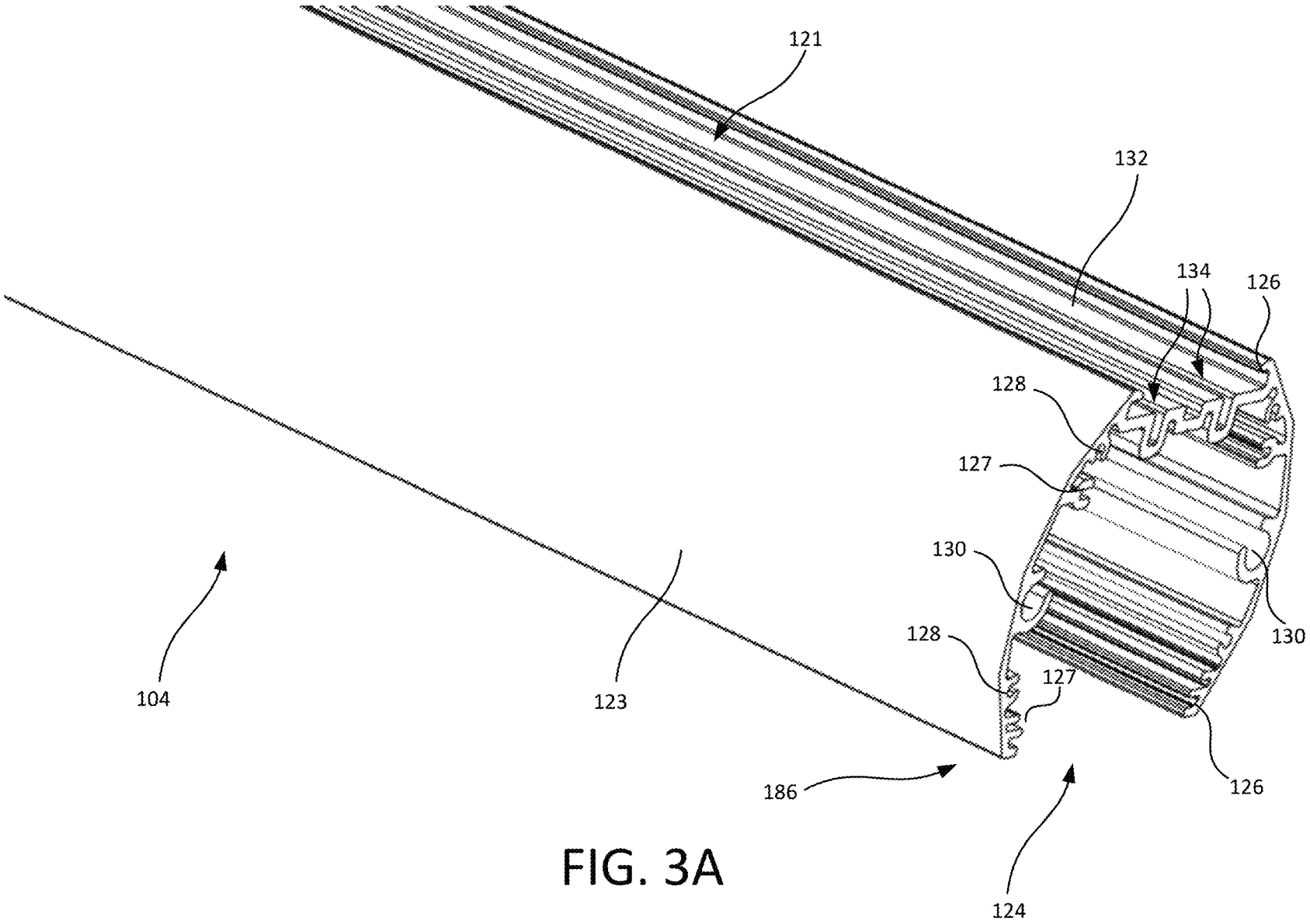
FIG. 3A is a perspective view of a housing of a light element according to embodiments.
Figure 3B:
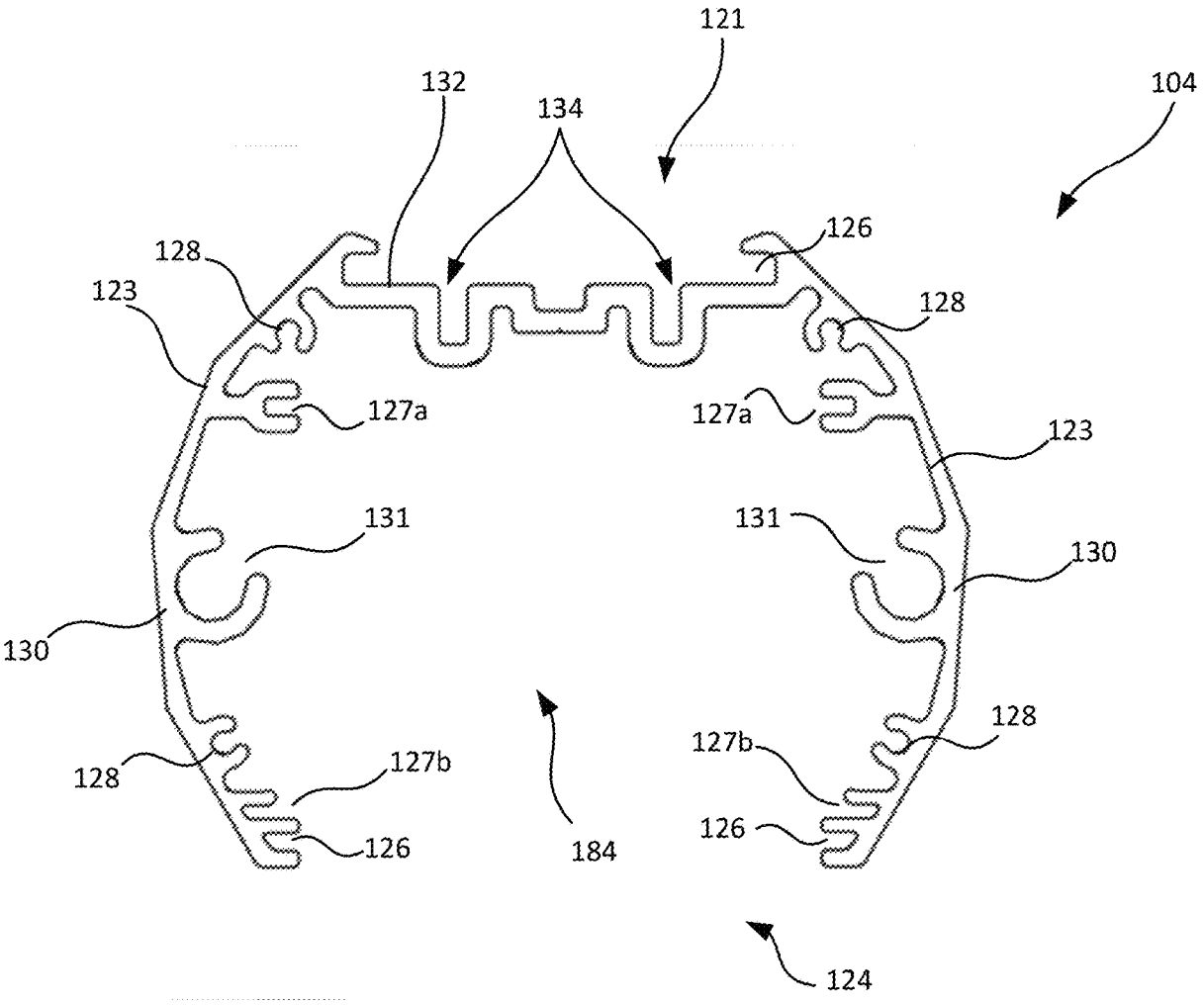
FIG. 3B is a front elevation view of the housing of FIG. 3A.

FIGS. 3A and 3B illustrate an embodiment of the housing 104 of one of the light elements 102. Here, housing 104 forms an elongated structure that houses internal components of the light element 102. The housing 104 includes a top surface 121, two sides 123, while having a bottom 124 that is at least partially open. The housing 104 may have any cross-sectional shape. For example, the housing 104 may have a generally circular, rectangular, octagonal, and/or other regular or irregular polygonal cross-section. Oftentimes, the housing 104 may have a symmetrical cross-section to provide a pleasing aesthetic.

Oftentimes, an optic, such as lens 106, may be positioned at the bottom 124 to cover the LEDs 108 and/or to direct and/or diffuse any light produced by the LEDs 108 and/or at a top of the housing 104 (in embodiments with uplight components). The housing 104 may include one or more grooves 126 on interior surfaces of either side 123 that allow flanges of the lens 106 to be inserted and retained within the housing 104. For example, grooves 126 may be provided at lower portions and/or upper portions of each side 123 so that the lens 106 may be secured to at least partially cover the bottom 124 of the housing 104 and/or a portion of the top surface 121 (in embodiments with uplight components). Additional grooves 127 (or other retention features) may be provided that help receive and support various components, such as the light engine and/or driver, reflector 111, PCB 110, and the like within the housing 104. For example, there may be one or more sets of grooves 127 at different heights within an interior 184 of the housing 104. In one particular embodiment (see FIG. 3B), one set of grooves 127*a* for receiving the light engine and/or driver may be positioned at a medial position within the interior 184, while a second set of grooves 127*b* for securing the reflector 111, PCB 110, and/or LEDs 108 may be positioned proximate the bottom 124 of the housing. In some embodiments, light sources, such as LEDs 108 may be supported by the top surface 121 of the housing 104 to provide uplighting solutions.

The interior 184 of the housing 104 may also define one or more fastener receptacles 128 that are used to receive fasteners (such as snaps, screws, pins, and the like) for securing an endcap 112 with an end 186 of the housing 104. While shown with four fastener receptacles 128, with one in an upper region and a lower region of each side 123 of the housing 104, it will be appreciated that other numbers and locations of fastener receptacles 128 may be utilized in some embodiments. One or more pin receptacles 130 may be located within the interior 184 of the housing 104 and are configured to receive a portion of the alignment pins 120. In some embodiments, the pin receptacles 130 may be fully enclosed on all sides, while in other embodiments, such as shown in FIG. 3B, the pin receptacles have an open portion 131. Such a design may help make manufacturing the housing 104 easier, as the part may be more easily extruded. An interior shape of each pin receptacle 130 may be sized and shaped to be slightly larger than the outer periphery of the alignment pins 120, allowing the alignment pins 120 to be easily inserted within the pin receptacles 130. As illustrated, two pin receptacles 130 are positioned in a central portion of the housing 104, however other numbers and positions of pin receptacles 130 may be used. While shown with two pin receptacles 130, it will be appreciated that any number of pin receptacles 130 may be provided, enabling any number of alignment pins 120 to be used.

The top surface 121 of the housing 104 may define a longitudinal channel 132 that provides a space to receive a portion of the connector plate 122. In some embodiments, the channel 132 may define one or more longitudinal slots 134 that extend parallel to the channel 132. The slots 134 may serve as receptacles for mating features of the connector plate 122 to help maintain the connector plate 122 in place and to prevent adjacent light elements 102 from sliding apart and laterally relative to each other.

FIGS. 4A-4D illustrate an embodiment of the endcap 112 for one of the light elements 102. The endcap 112 may be coupled with an end of the housing 104 to provide a location to mate multiple light elements 102 together in an end to end configuration. In some embodiments, the endcap 112 may have the same or similar outer shape as the housing 104 so as to provide a generally uniform appearance when installed, although some embodiments may employ an endcap 112 that has a different shape than the housing 104. In some embodiments, the endcap 112 may be slightly larger or smaller than the housing 104. This may make the endcaps 112 (and connections between light elements 102) easier to identify when servicing the linear light fixture 100. In some embodiments, the endcap 112 and housing 104 may be formed integrally. In other embodiments, the endcap 112 and housing 104 are formed separately and later joined. For example, the endcap 112 may define a number of apertures 136 that receive fasteners 114 that extend through an entirety of the endcap 112 and into the fastener receptacles 128 of the housing 104 to secure the components together. The endcap 112 may define a central aperture 138 that enables power cables to be inserted into the housing 104 to power the light engine and/or driver within the housing 104. A top surface 140 of the endcap 112 may also define a channel 142 that, when interfaced with the housing 104, is in alignment with the longitudinal channel 132 of the housing 104. Together channels 132, 142 provide a location for receiving the connector plate 122 to align adjacent light elements 102.

Figure 4A:
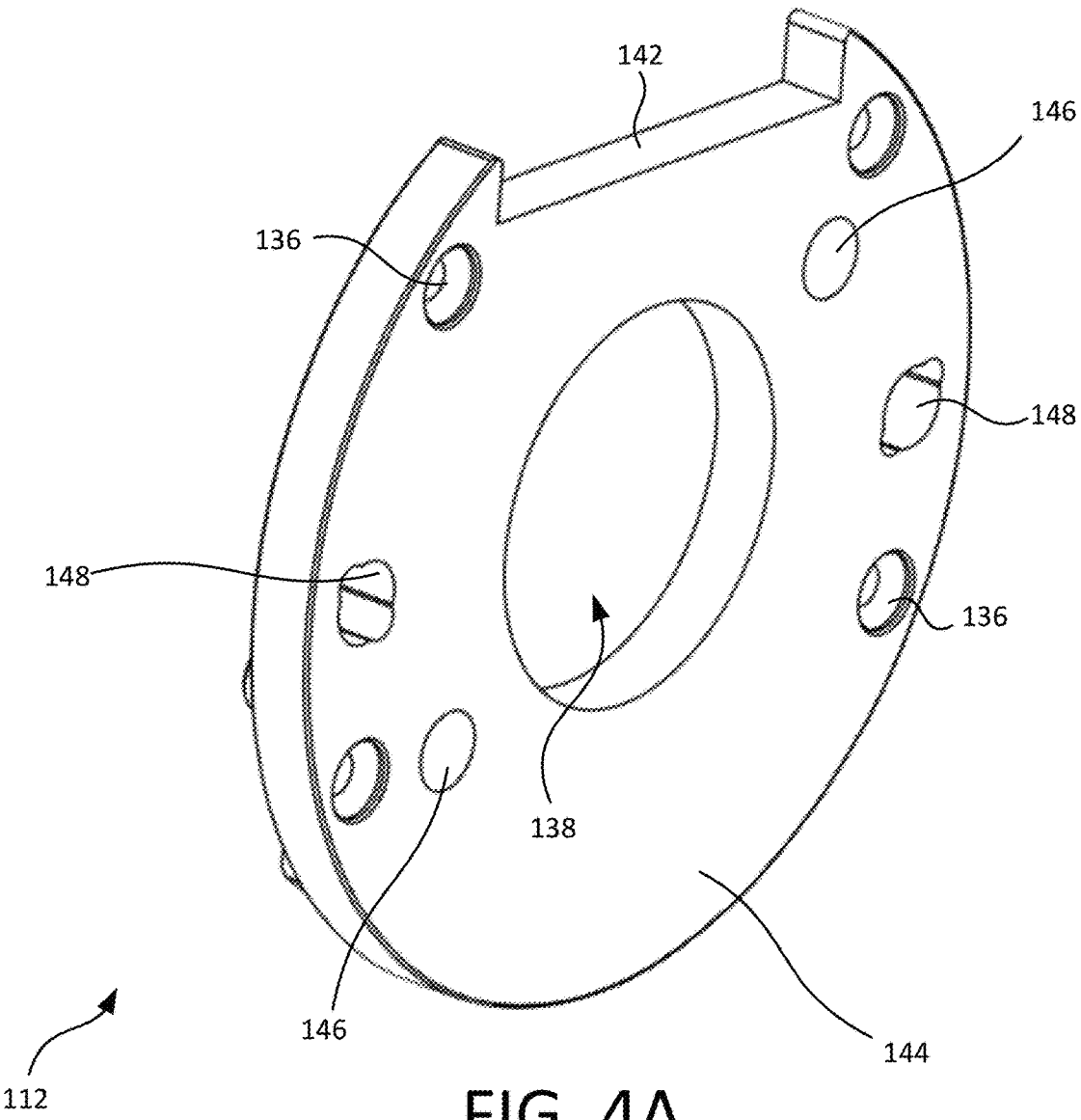
FIG. 4A is a front perspective view of an endcap of a light element according to embodiments.
Figure 4B:
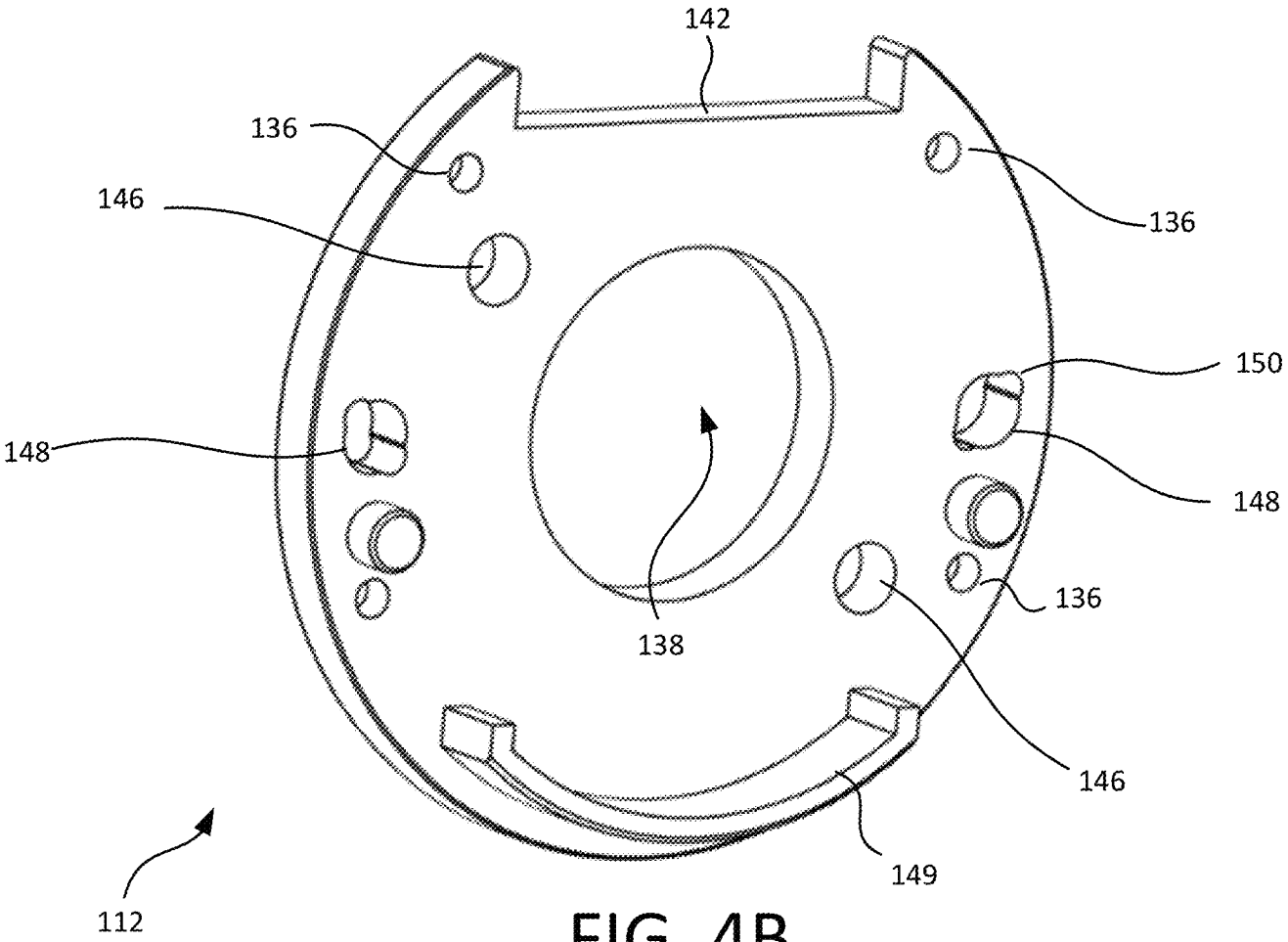
FIG. 4B is a rear perspective view of the endcap of FIG. 4A.
Figure 4C:
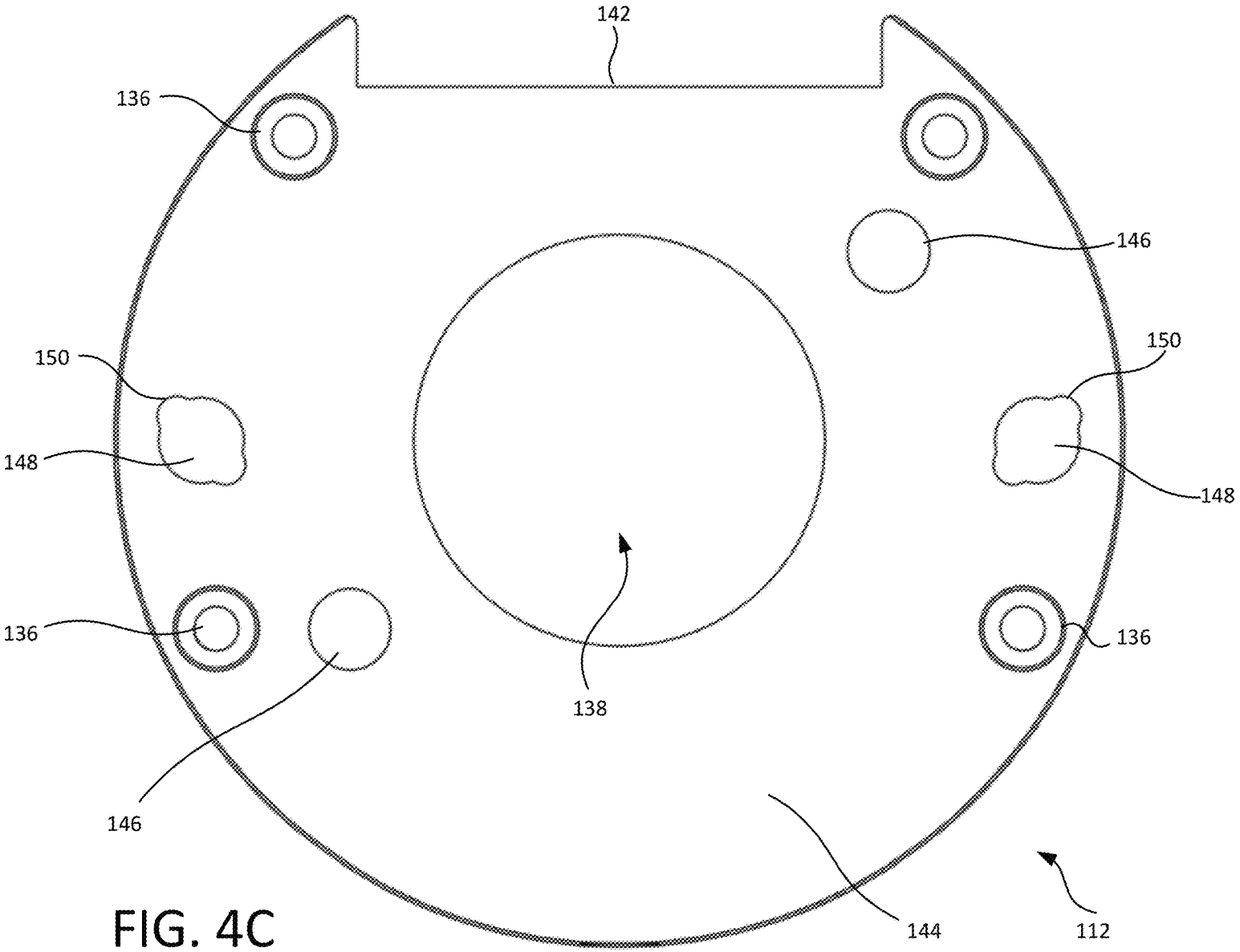
FIG. 4C is a front elevation view of the endcap of FIG. 4A.
Figure 4D:
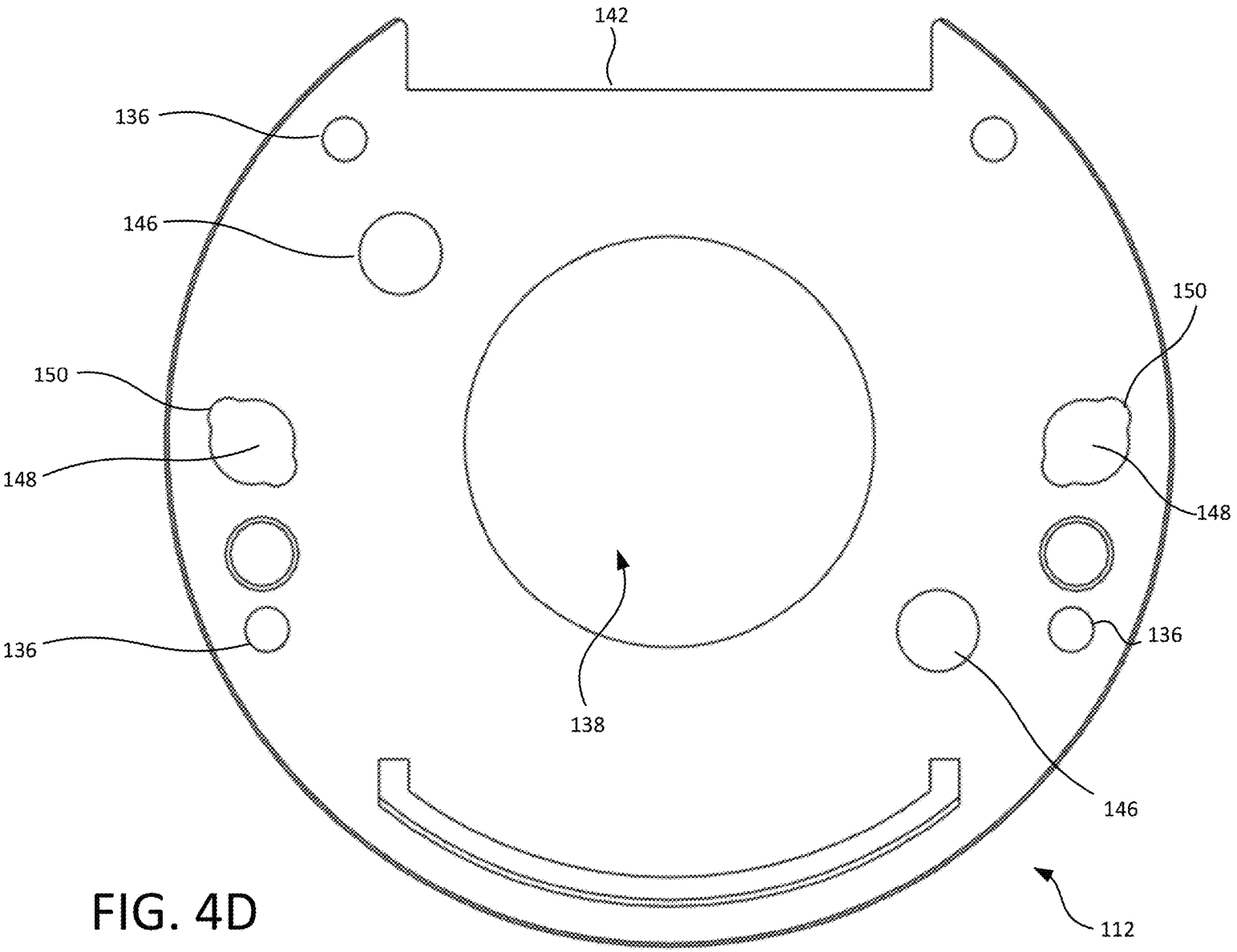
FIG. 4D is a rear elevation view of the endcap of FIG. 4A.

The endcap 112 may include a number of additional alignment features. For example, a face 144 of the endcap 112 may define recesses or apertures 146 that may receive corresponding protrusions 152 of the hanger insert 116 to help align the endcap 112 and hanger insert 116 to ensure that adjacent light elements 102 are linearly aligned when installed. The apertures 146 may be positioned at any portion of an outer face 144 of the endcap 112 and may extend fully or partially through a thickness of the endcap 112. While shown here with apertures 146 at opposing heights and sides of the endcap 112, other locations are possible. Additionally, any number, size, and/or arrangement of apertures 146 may be utilized in different embodiments. It will be appreciated that in some embodiments, the endcap 112 may include protrusions that are insertable within recesses or apertures formed within the hanger insert 116. The endcap 112 may include shields 149 that may cover an end of the LEDs 108 when the linear light fixture 100 is assembled to help prevent light from an end of the LEDs 108 from leaking out proximate the end cap 112, as such light may be stronger and uneven relative to light from the reflector 111 and/or lens 106. The endcap 112 may also define a number of apertures 148 that receive alignment pins 120. These apertures 148 may be positioned on the endcap 112 such that when the endcap 112 is interfaced with the housing 104 the apertures 148 are aligned with the pin receptacles 130 of the housing 104. As best illustrated in FIGS. 4C and 4D, apertures 148 can have, but do not have to have, non-circular cross-sections. For example, as illustrated, each aperture 148 has a primary circular cross-section that includes notches 150 on opposing sides of the aperture 148. These notches 150 enable projections (as described in relation to FIGS. 6A and 6B) from the alignment pins 120 to pass though the endcap 112, where at least one of the projections contacts a wall of the pin receptacles 130 to limit an insertion depth of the alignment pins 120 into the housing 104. It will be appreciated that in some embodiments the cross-sectional shape of the apertures 148 may be different and is dictated by the outer shape of the alignment pins 120.

Figure 5A:
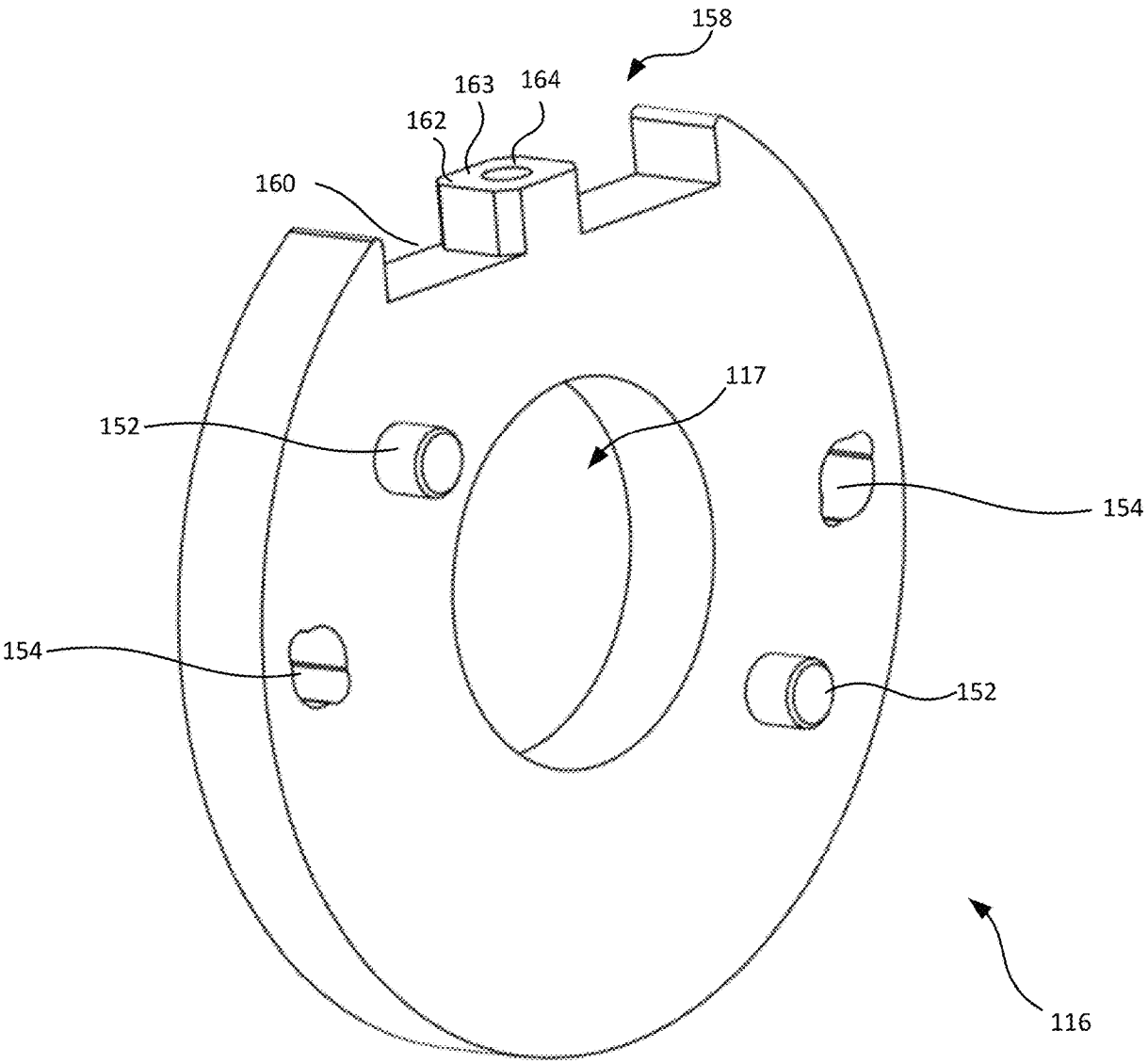
FIG. 5A is a perspective view of a hanger insert according to embodiments.
Figure 5B:
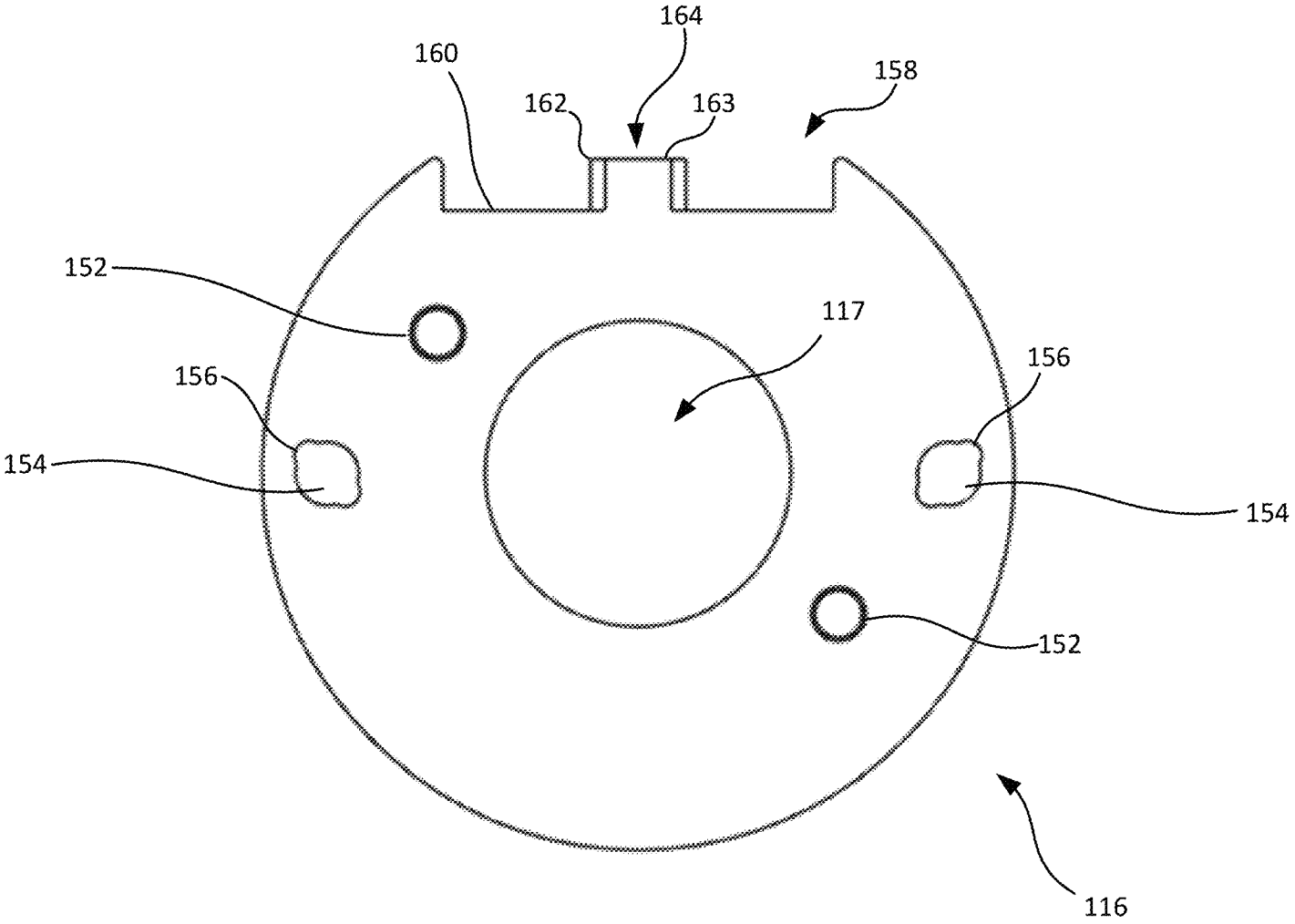
FIG. 5B is a front elevation view of the hanger insert of FIG. 5A.

FIGS. 5A and 5B illustrate an embodiment of the hanger insert 116. Hanger insert 116 may be positioned between endcaps 112 of adjacent light elements 102 and may be used to align and couple the light elements 102 together and provide an attachment point for the hanging mechanism 118. Oftentimes, the hanger insert 116 may have a similar size and shape as the endcaps 112 to provide a generally uniform looking connection point between adjacent light elements 102. The hanger insert 116 may define a central aperture 117. Each face of the hanger insert 116 may include a number of protrusions 152 that are aligned with and insertable within the apertures 146 of the endcaps 112 to help align and mate the hanger insert 116 with each of the endcaps 112. The hanger insert 116 may also define a number of apertures 154 that receive alignment pins 120. These apertures 154 may be aligned with the apertures 148 and pin receptacles 130 when the hanger insert 116 is interfaced with the endcaps 112 and housing 104. As best illustrated in FIG. 5B, apertures 154 can have, but do not have to have, non-circular cross-sections (often matching the size and shape of apertures 148 of the endcaps 112). For example, as illustrated, each aperture 154 has a generally circular cross-section that includes notches 156 on opposing sides of the aperture 154. These notches 156 enable projections from the alignment pins 120 to pass though the hanger insert 116.

A top surface 158 of the hanger insert 116 may define a channel 160 that, when coupled with the endcaps 112 and housings 104, is in alignment with the longitudinal channel 132 of the housing 104 and the channel 142 of each endcap 112. Together channels 132, 142, and 160 provide a location for receiving the connector plate 122 to align adjacent light elements 102. A hanger connection 162 may be disposed within the channel 160, with the hanger connection 162 serving as a connection point for the hanging mechanism 118. In some embodiments, the hanger connection 162 may define a receptacle 164 for receiving a fastener and/or other coupling mechanism (such as a magnet, clip, clamp, quick connect mechanism, and/or other mechanical securement device) of the hanging mechanism 118 that secures the light elements 102 to a ceiling or other structure. For example, the hanging mechanism 118 may include a coupling mechanism attached to a cable that is suspended (or configured to be suspended) from a ceiling or other overhead structure. The coupling mechanism may be secured within the receptacle 164 to suspend the light elements 102. As just one example, the coupling mechanism may be a Griplock® aircraft cable fitting that has a threaded end that may be threaded into the receptacle 164. In some embodiments, the hanger connection 162 may be flush with a bottom surface of the channel 160, while in other embodiments the hanger connection 162 may protrude above the bottom surface of the channel 160. For example, as illustrated in FIGS. 5A and 5B, the hanger connection 162 may extend upward from a central portion of the channel 160, with a top surface 163 of the hanger connection 162 providing the receptacle 164. Such a design may help to properly align a center of the connector plate 122 with the receptacle 164 as a central aperture 170 of the connector plate 122 may be positioned about the extended hanger connection 162 to properly position the connector plate 122. The hanger connection 162 may have a generally rectangular shape as illustrated here, however other shapes are possible.

Figure 6A:
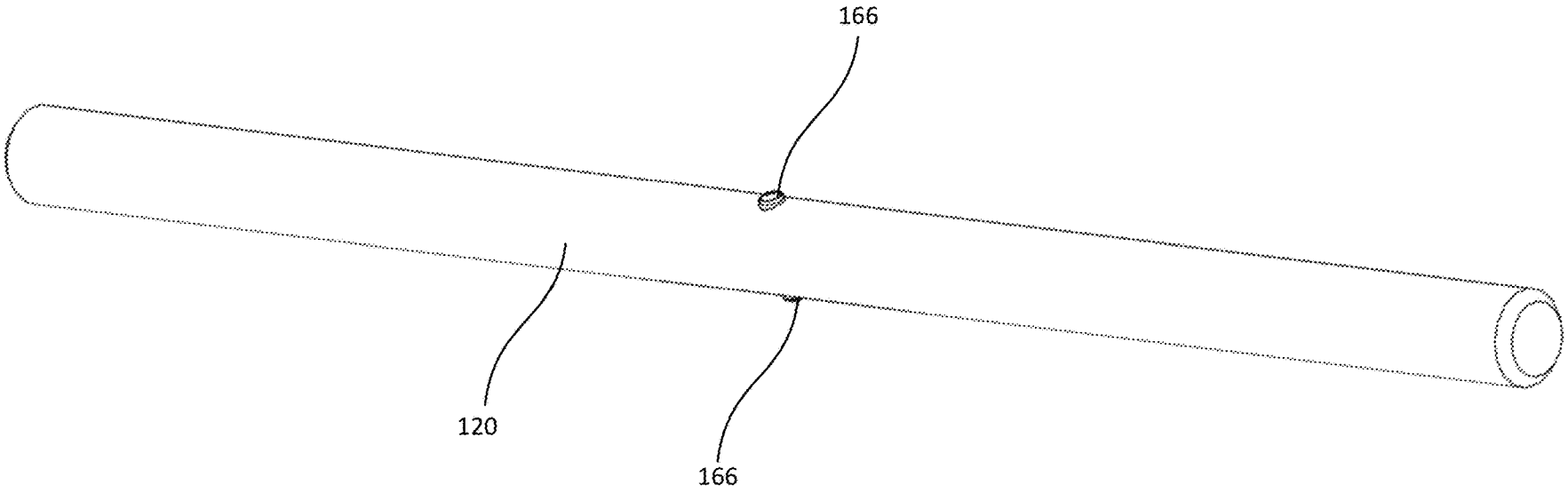
FIG. 6A is a perspective view of an alignment pin according to embodiments.
Figure 6B:
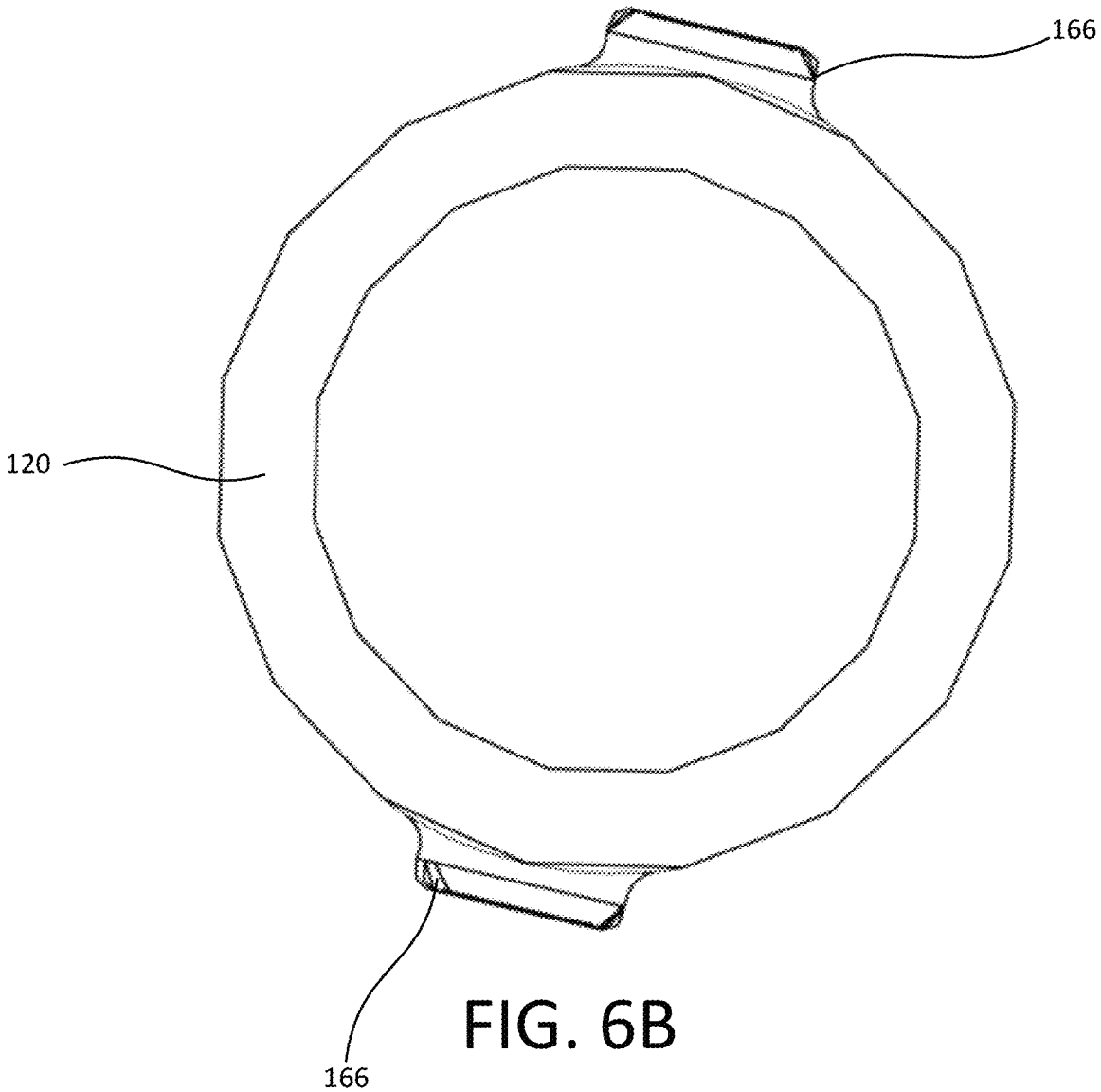
FIG. 6B is a front elevation view of the alignment pin of FIG. 6A.
Figure 7A:
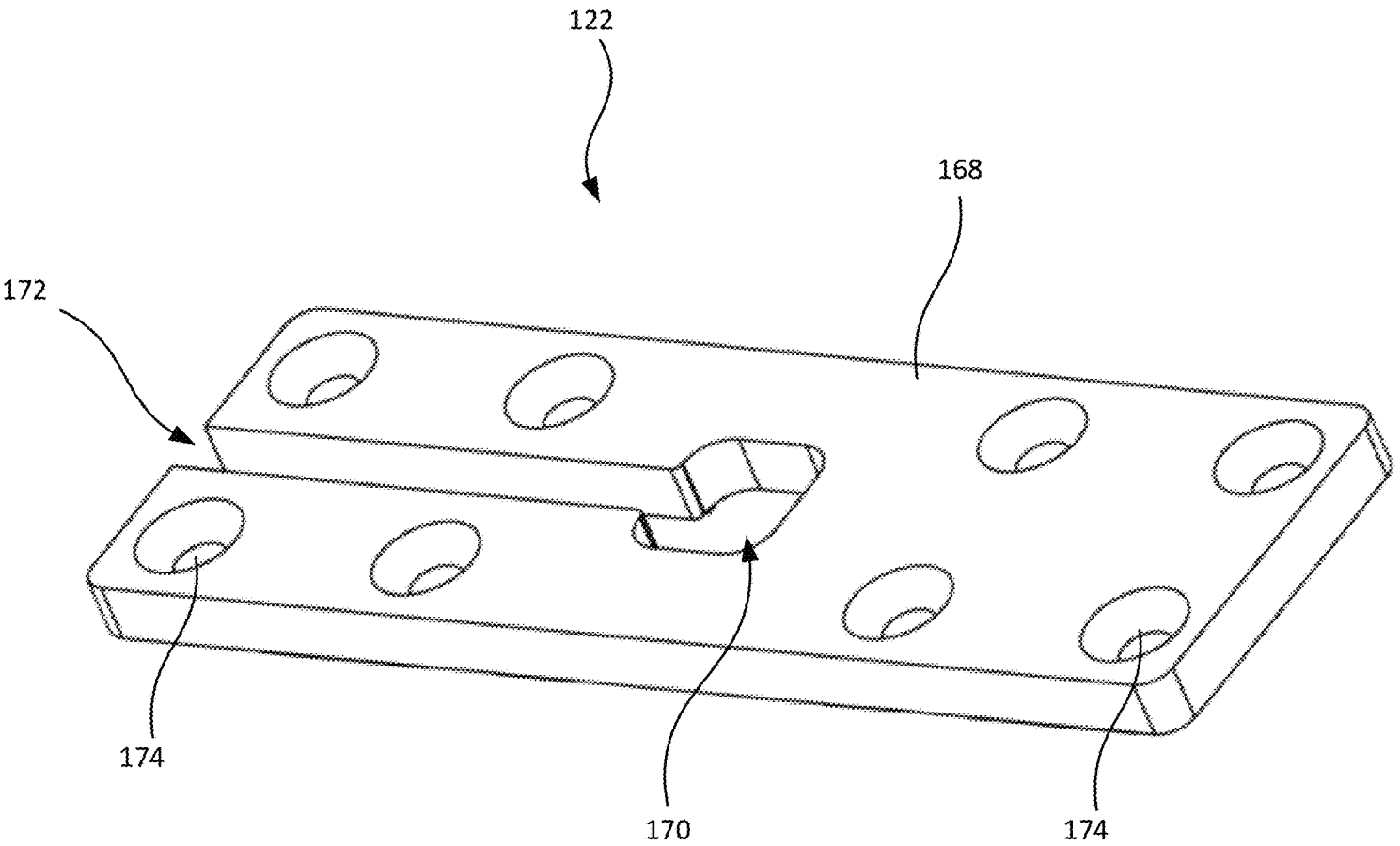
FIG. 7A is a top perspective view of a connector plate according to embodiments.
Figure 7B:
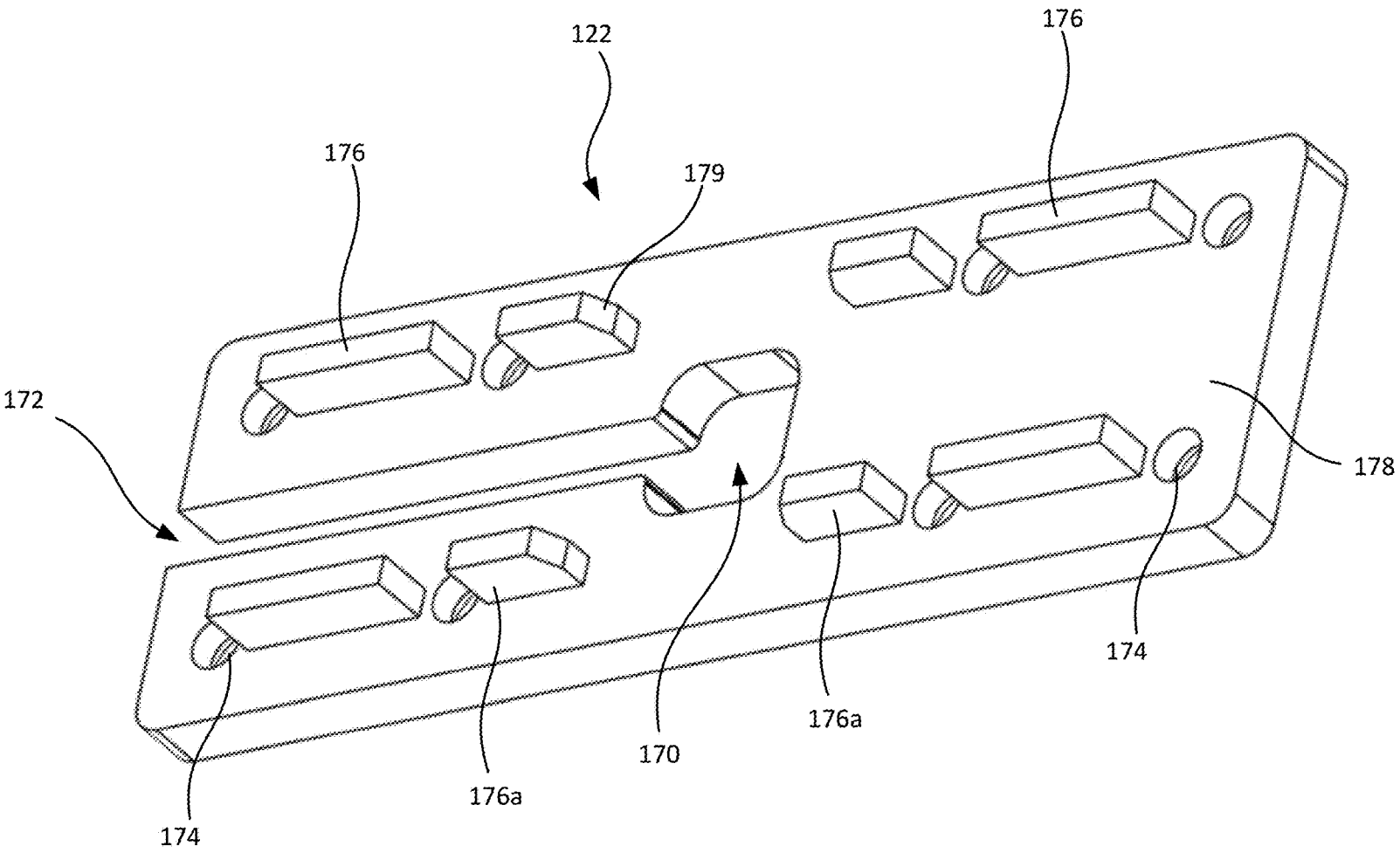
FIG. 7B is a bottom perspective view of the connector plate of FIG. 7A.
Figure 7C:
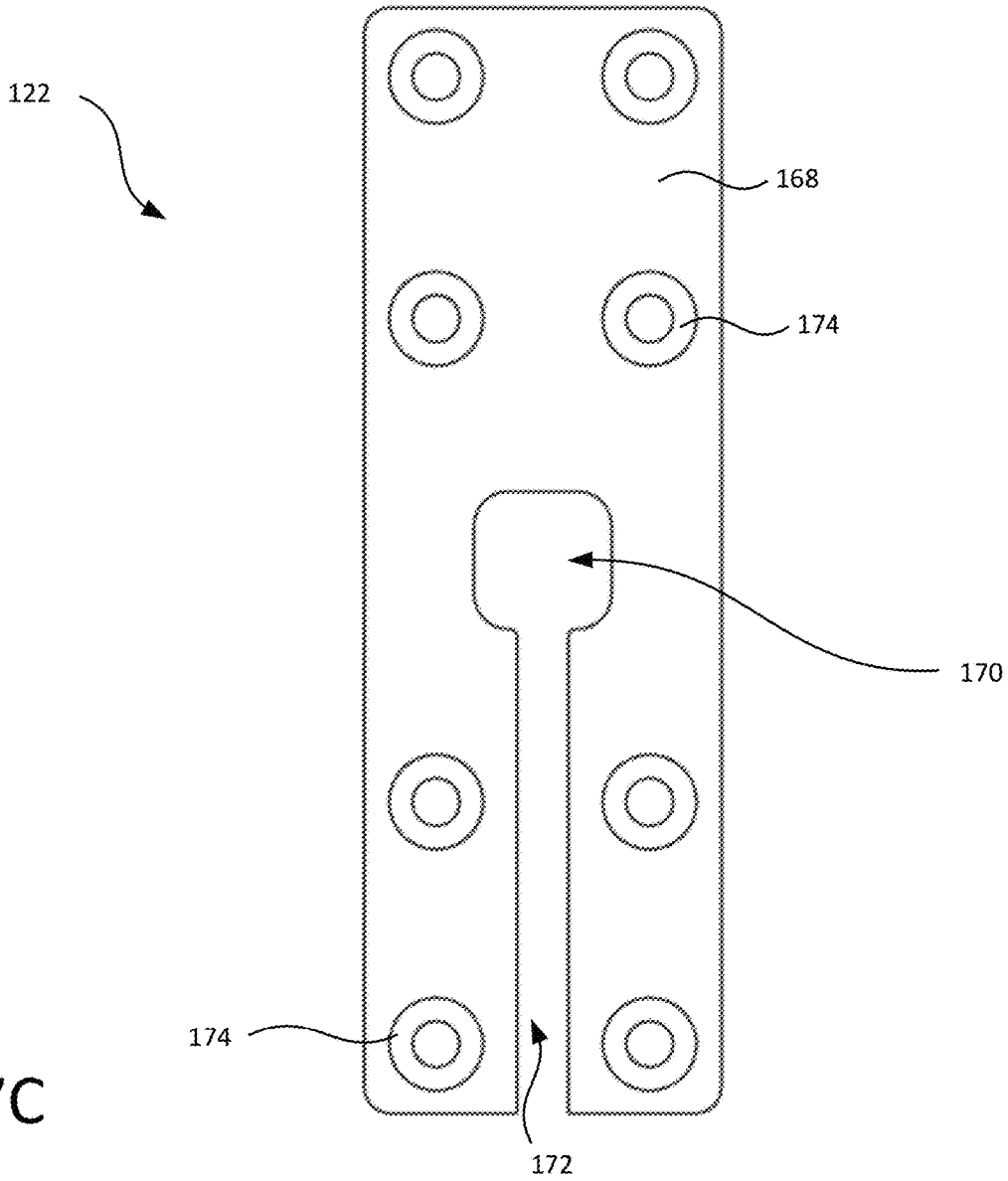
FIG. 7C is a top plan view of the connector plate of FIG. 7A.
Figure 7D:
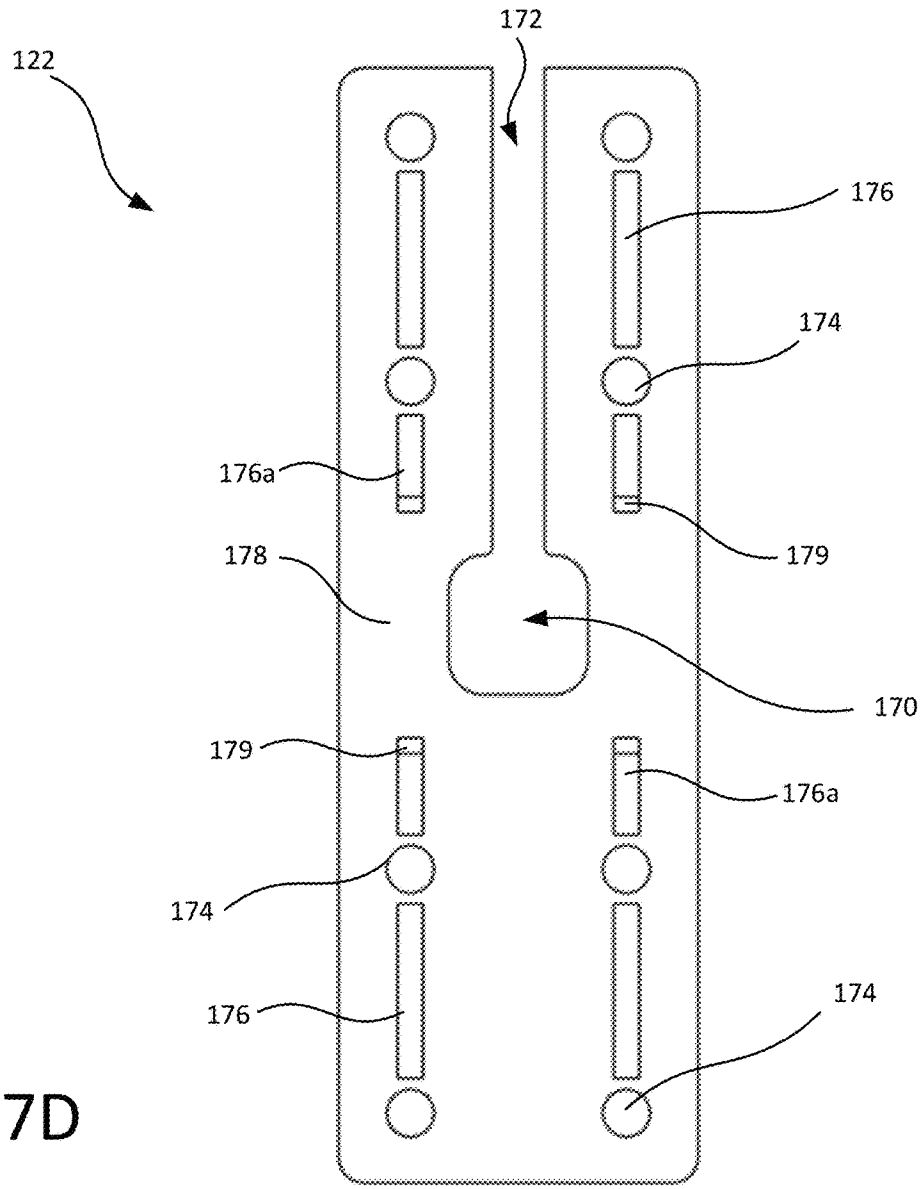
FIG. 7D is a bottom plan view of the connector plate of FIG. 7A.
Figure 7E:
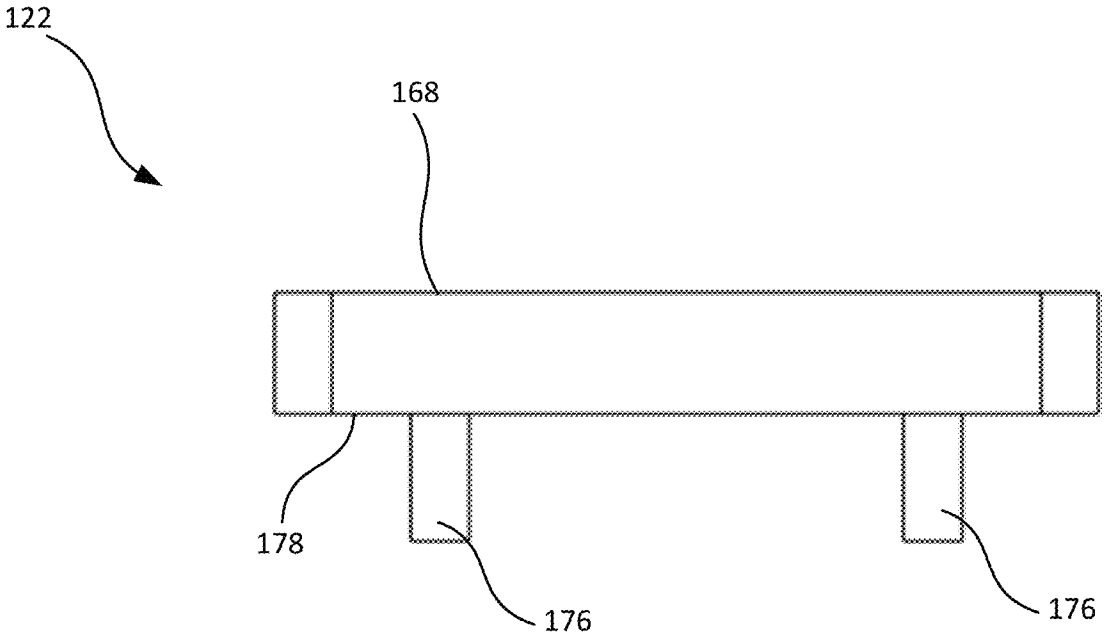
FIG. 7E is a front elevation view of the connector plate of FIG. 7A.

FIGS. 6A and 6B illustrate an embodiment of the alignment pin 120. The alignment pin 120 may be an elongate rod that has a length that allows the alignment pin 120 to extend entirely through the widths of two endcaps 112 and the hanger insert 116, with ends of the alignment pin 120 extending partially into the pin receptacles 130 of the housing 104. This ensures that each alignment pin 120 is sufficiently long to extend through, align, and support the entire connection formed between adjacent light elements 102. To help maintain the alignment pins 120 in a desired position (with a portion of the body of the alignment pin 120 extending fully through the widths of two endcaps 112, the hanger insert 116, and partially into the pin receptacles 130 of two housings 104), each alignment pin 120 may include a number of projections 166 or other protrusions that protrude outward from the sides of the alignment pin 120. The projections 166 may contact a distal edge of one of the pin receptacles 130 of the housing 104 and prevent the alignment pin 120 from passing any further into the interior 184 of the housing 104. As shown here, a medial portion of the alignment pin 120 includes projections 166 on opposing sides of the alignment pin 120. By positioning the projections 166 proximate a center of the alignment pin 120 and making the alignment pins 120 pins of sufficient length (with a length of each half of the alignment pin 120 being greater than the combined widths of two endcaps 112 and the hanger insert 116), it can be assured that if the alignment pin 120 slides to an extreme position within one of the light elements 102, a portion of the alignment pin 120 still extends into the pin receptacles 130 of each of the housings 104 to ensure that the light elements 102 remain aligned and supported with one another. It will be appreciated that other designs and/or locations of projections or other stop mechanisms may be used. For example, in some embodiments, the alignment pin 120 may have a protruding rib that limits the insertion depth of the alignment pin 120. In other embodiments, projections 166 and/or other features may be positioned proximate each end of the alignment pin 120 to maintain the alignment pin 120 in the desired position. Additionally, rather than having two projections 166 positioned on opposing sides of the alignment pin 120 as shown here, two or more projections 166 may be positioned around the periphery of the alignment pin 120 at regular and/or irregular intervals. In some embodiments in which the pin receptacles 130 of the housing have a fully enclosed periphery, the alignment pins 120 may include only a single up-set dimple 166.

FIGS. 7A-7E illustrate an embodiment of the connector plate 122. The connector plate 122 may be sized and shaped to fit within the channels 132, 142, and 160 and may serve to lock adjacent light elements 102 together in a horizontal position. For example, the connector plate 122 may be generally rectangular in shape, with a width that fits between opposing edges of the channels 132, 142, and 160. In some embodiments, a height of the connector plate 122 may be substantially similar to a depth of the channels 132, 142, and 160 such that when the connector plate 122 is inserted within the channels 132, 142, and 160, a top surface 168 of the connector plate 122 may be flush or substantially flush with top surfaces of the housing 104, endcaps 112, and/or hanger insert 116. In other embodiments, a thickness of the connector plate 122 may be less than or greater than the depth of the channels 132, 142, and 160. In some embodiments, the top surface 168 of the connector plate 122 may extend above the top surfaces of the housing 104, endcaps 112, and hanger insert 116 and may have a curved surface to provide a generally rounded appearance to the top of the linear light fixture 100.

The connector plate 122 may define a central aperture 170 that is configured to be aligned with the hanger connection 162 to enable the hanging mechanism 118 to be passed through the central aperture 170 and inserted into the receptacle 164 of the hanger connection 162 to secure the light elements 102 to a ceiling or other structure. In embodiments in which the hanger connection 162 is raised above a bottom surface of the channel 160, the central aperture 170 may be sized and shaped to closely match the size and shape of the hanger connection 162, which may help the connector plate 122 be aligned and stay aligned within the channels 132, 142, and 160. In some embodiments, a slot 172 may extend through the entire thickness of the connector plate 122 from the central aperture 170 through one of the peripheral sides (lateral side and/or end) of the connector plate 122. The slot 172 may be linear as illustrated, or may include one or more curved sections or jogged sections. The slot 172 allows the connector plate 122 to be secured to the housings 104, endcaps 112, and/or hanger insert 116 after the hanger insert 116 is secured to a ceiling or other structure. This also allows the hanger insert 116 to remain coupled with the hanging mechanism 118 when the connector plate 122 is removed, which enables a single light element 102 to be removed from the alignment pins 120 for service or replacement while the remaining light elements 102 remain secured to the ceiling or other structure via the hanger insert 116 and hanging mechanism 118.

The connector plate 122 may define a number of fastener apertures 174 that may extend through a thickness of the connector plate 122. Each fastener aperture 174 may receive a fastener, such as a self-threading screw, screw, bolt, etc. that is used to secure the connector plate 122 to the housings 104, endcaps 112, and/or hanger insert 116. For example, in some embodiments, self-threading screws may be inserted through the fastener apertures 174 where threads of the screws engage side walls of the longitudinal slots 134 of the housing 104 to secure the connector plate 122 and housing 104 together.

In some embodiments, to further prevent adjacent light elements 102 from sliding apart from one another, the connector plate 122 may include a number of fins 176 that extend from a bottom surface 178 of the connector plate 122. The fins 176 may have widths that fit within the longitudinal slots 134 of the housing 104. This allows the fins 176 to be inserted within the longitudinal slots 134 of each of the housings 104 where interior edges of the inner most fins 176*a* abut the endcaps 112 to prevent adjacent light elements 102 from being horizontally separated while the connector plate 122 is positioned within the channels 132, 142, and 160. In some embodiments, the innermost fins 176*a* may have beveled corners 179, which help facilitate the insertion of the fins 176 within the longitudinal slots 134 and past the edges of the endcaps 112. It will be appreciated that while illustrated with two parallel sets of fins 176 on either side of the central aperture 170, some embodiments may use a single set of fins 176 or more than two sets of fins 176 on either side of the central aperture 170. In some embodiments, the fastener apertures 174 may be positioned between some or all of the fins 176, while in other embodiments the fastener apertures 174 may be positioned entirely inward or outward from the fins 176. Once the connector plate 122 is secured within the channels 132, 142, and 160, the adjacent light elements 102 are secured in vertical and horizontal directions and may form the linear light fixture 100 until one of the light elements 102 needs to be serviced and/or replaced.

Figure 8:
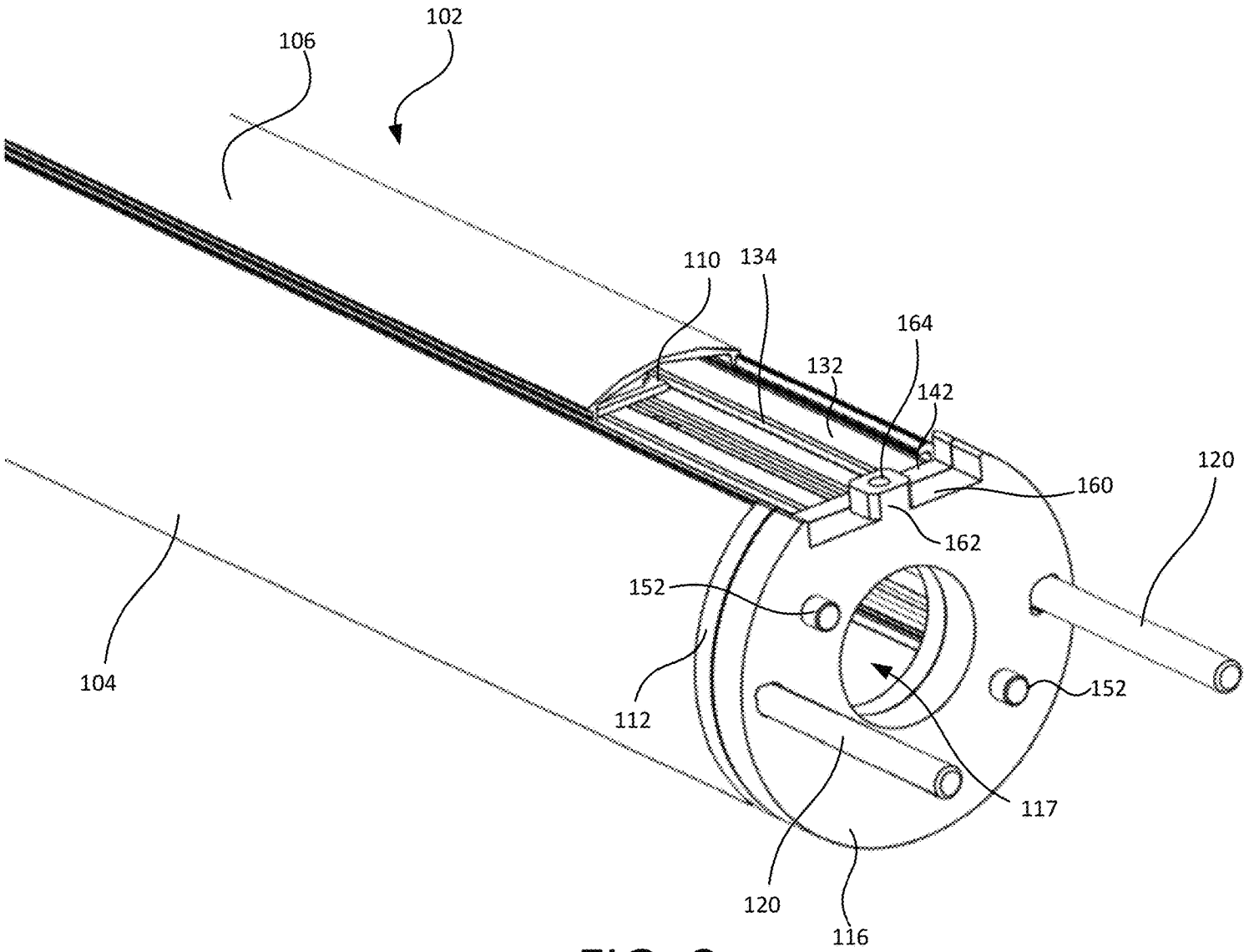
FIG. 8 illustrates the connection of FIG. 2A in a partially assembled state.
Figure 9:
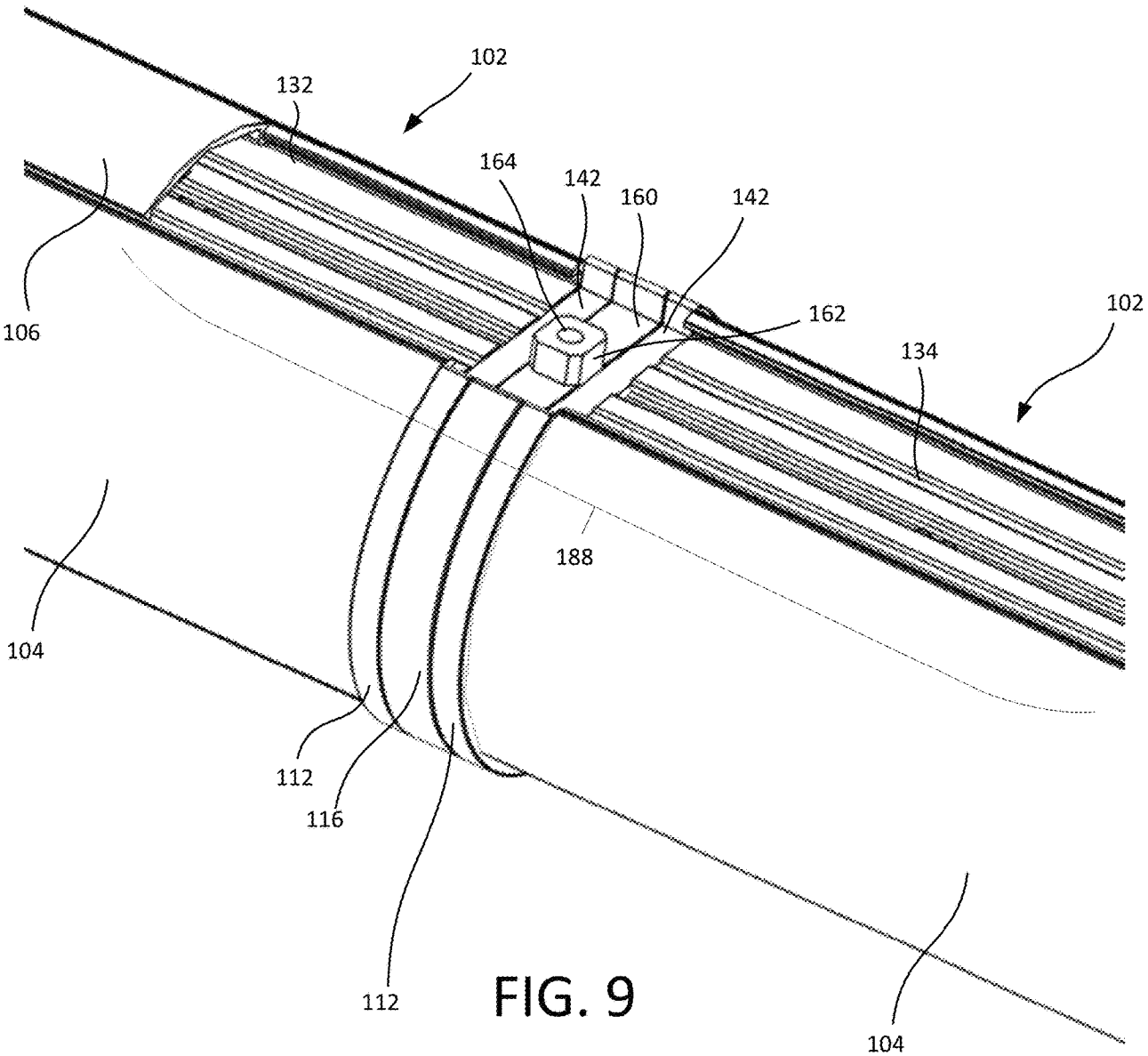
FIG. 9 illustrates the connection of FIG. 2A in a partially assembled state.

In operation, to secure two light elements 102 together in an end to end configuration, the hanger insert 116 is first positioned against an endcap 112 of a first of the light elements 102 as shown in FIG. 8. In this position, the protrusions 152 on a first face of the hanger insert 116 are received within the apertures 146 of the endcap 112, while the apertures 148, 154 of the hanger insert 116 and endcap 112 are in alignment. Additionally, the channels 132 and 142 of the first housing 104 and endcap 112 are aligned with the channel 160 of the hanger insert 116. In this position, the alignment pins 120 may be inserted into the apertures 154 of the hanger insert 116, with ends of the alignment pins 120 passing through the apertures 148 of the endcap 112 and into the pin receptacles 130 of the housing 104. The projections 166 of the alignment pins 120 prevent the alignment pins 120 from passing too deep within the pin receptacles 130. Once the alignment pins 120 are in position, the second light element 102 may be positioned adjacent the first light element 102 by inserting the exposed ends of the alignment pins 120 into the apertures 148 of the endcap 112 of the second light element 102 and sliding the endcap 112 of the second light element 102 up against the hanger insert 116 such as illustrated in FIG. 9. In this position, the protrusions 152 on the second face of the hanger insert 116 are inserted within the apertures 146 of the endcap 112 of the second light element 102. The central apertures 138, 117 of each of the endcaps 112 and the hanger insert 116 are in alignment, enabling power cables to pass from one light element 102 to the other through a central channel formed by the central apertures 138, 117. Additionally, the channels 132, 142, and 160 are all in alignment such that the channels 132, 142, and 160 form an elongate channel 188 (see FIG. 9) that may receive the connector plate 122.

Figure 10:
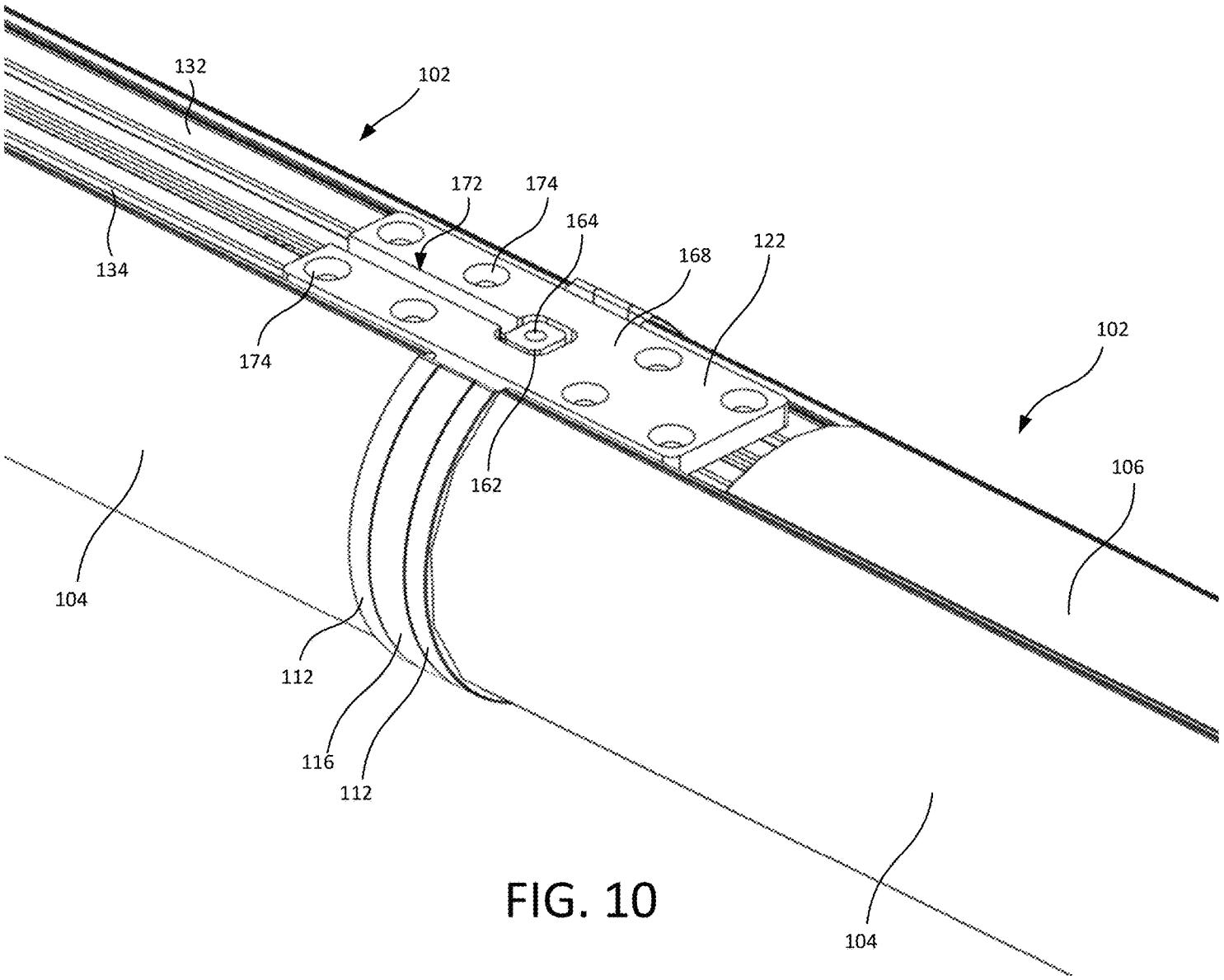
FIG. 10 illustrates the connection of FIG. 2A in a partially assembled state.

Once the endcaps 112 of both of the light elements 102 are positioned against the hanger insert 116, the light elements 102 may be secured to a ceiling or other structure and/or the connection plate 122 may be secured to the light elements 102. In some embodiments, the connector plate 122 may be positioned within the elongate channel 188 formed by channels 132, 142, and 160 as illustrated in FIG. 10. This may be done by inserting fins 176 within the longitudinal slots 134 formed within the top surface of the housings 104, with innermost fins 176*a* being positioned against so as to abut one of the respective endcaps 112. The central aperture 170 of the connector plate 122 may be aligned with and receive the hanger connection 162, providing access to the receptacle 164. In some embodiments, when the connector plate 122 is in position within the elongate channel 188 formed by channels 132, 142, and 160, the top surface 168 of the connector plate 122 is flush or substantially flush with a top edge of the elongate channel 188. To secure the connector plate 122 to the light elements 102, a number of fasteners may be inserted through the fastener apertures 174 of the connector plate 122 and into the longitudinal slots 134. As just one example, self-threading screws 180 (see FIG. 2A) may be inserted within the fastener apertures 174, with the threads of each screw 180 engaging side walls of the longitudinal slots 134 to secure the connector plate 122 against the housings 104, endcaps 112, and hanger insert 116 as shown in FIG. 2. The hanging mechanism 118, such as a cable attachment mechanism, may be secured within the receptacle 164, enabling the light elements 102 to be secured to a ceiling or other structure and form a suspended linear light fixture 100.

In other embodiments, prior to securing the connection plate 122 to the light elements 102, the hanging mechanism 118, such as an aircraft cable adapter, may be secured within the receptacle 164 to suspend the light elements 102 to the ceiling or other structure. In such embodiments, once the light elements 102 are secured to the ceiling, the connector plate 122 may be secured to the light elements 102. For example, the slot 172 of the connector plate 122 may be positioned about the cable of the hanging mechanism 118 and the central aperture 170 may be maneuvered over the hanger connection 162. The connector plate 122 may then be affixed to the light elements 102 in a similar manner as described above.

One advantage of the present mounting system is the ability to easily remove and/or replace a single light element 102 in the linear light fixture 100 formed of a number of light elements 102 without the need to remove any other light elements 102 of the linear light fixture 100 from the ceiling or other structure. To remove only a single light element 102 from a suspended fixture 100, a user may first remove the fasteners (such as self-threading screws 180) from the connector plate 122. The user may then lift up on the connector plate 122 so as to disengage the hanger connection 162 from central aperture 170. The connector plate 122 may then be removed from the assembly by backing connector plate 122 out such that the cable of the hanging mechanism 118 (and/or other coupling mechanism that supports the light fixture 100 from the ceiling) rides along the slot 172. Removal of the connector plate 122 enables the light elements 102 to be slid away from one another. The light element 102 that is to be removed may be pulled away from the hanger insert 116 (while the hanger insert 116 remains coupled with the ceiling or other structure via the coupling mechanism 118) and slid off of the alignment pins 120. Once the light element 102 is removed from the alignment pins 120, the light element 102 may be removed, repaired, and/or replaced while the remaining light elements 102 remain suspended by the hanger inserts 116 of the light fixture 100. Light elements 102 that are positioned in the middle of a light fixture 100 may need to be removed from hanger inserts 116 on either end of the light element 102 in order to remove the light element 102 from the fixture 100.

Figure 11A:
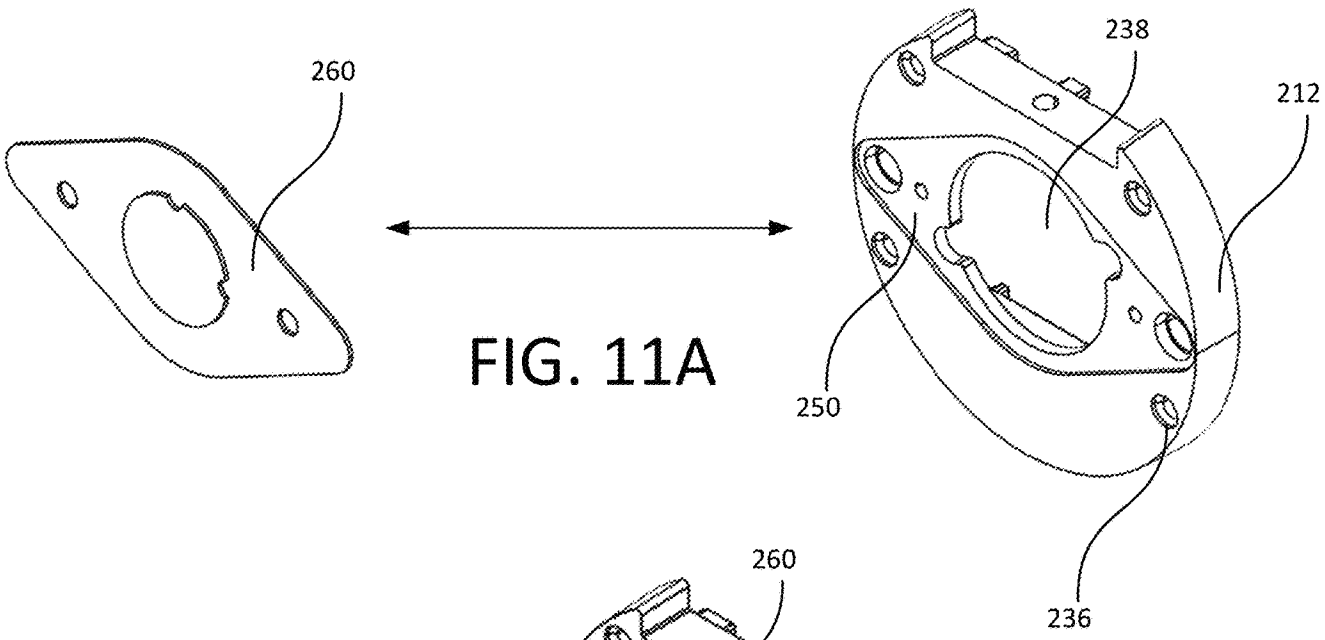
FIG. 11A an exploded view an endcap assembly of a light element according to embodiments.
Figure 11B:
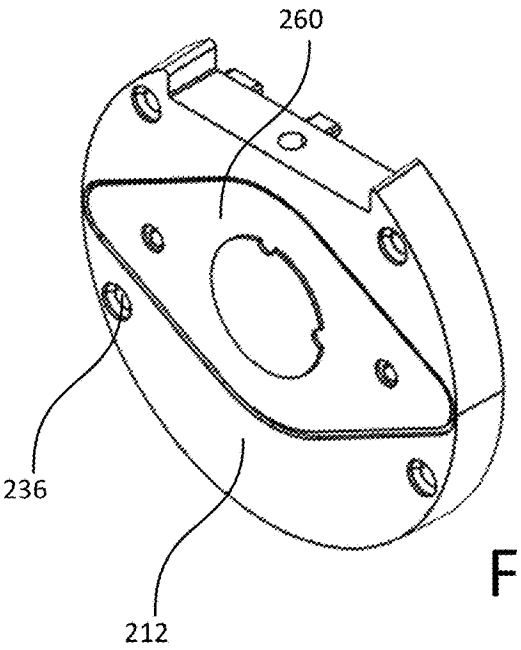
FIG. 11B illustrates the endcap assembly of FIG. 11A in an assembled state.

In some embodiments, the hanging systems described herein may be designed such that an endcap may be positioned at an interface between two light elements or at an outermost end of a linear light fixture. FIGS. 11A and 11B illustrate an embodiment of an endcap 212 that may be used at both interior and exterior positions of a linear light fixture, such as linear light fixture 100. End endcap 212 may have a similar structure and functionality as end cap 112 described above. For example end cap 212 may be coupled with an end of a housing of a light element to provide a location to mate multiple light elements together in an end to end configuration. The endcap 212 may define a number of apertures 236 that receive fasteners that extend through an entirety of the endcap 212 and into fastener receptacles of the housing to secure the components together. The endcap 212 may define a central aperture 238 that enables power cables to be inserted into the housing to power the light engine and/or driver within the housing. A top surface 240 of the endcap 212 may also define a channel 242 that may receive a connector plate (such as connector plate 122) to align adjacent light elements. The endcap 212 may include a number of additional alignment features similar to those described in relation to endcap 112.

End cap 212 may also define a recessed portion 250, which may extend about an area that includes the central aperture 238 and some or all of the alignment features. A cover 260 may be sized and shaped to be inserted within the recessed portion 250 to close the opening of the central aperture 238 and any alignment features within the recessed portion, as illustrated in FIG. 11B. The cover 260 may have a thickness that substantially matches a depth of the recessed portion 250 such that when the components are interfaced together, outer surfaces of the endcap 212 and the cover 260 are substantially flush with one another. This provides the endcap 212 with a closed and aesthetically pleasing look when the endcap 212 is positioned at an outermost end of a linear light fixture. Such a design also helps seal the outermost ends of the linear light fixture from any dirt or dust ingress through the central aperture 238 and/or alignment features. The cover 260 may be secured to the endcap 212 using fasteners, magnets, snap connections, and/or other coupling techniques. When the cover 260 is removed or absent from the endcap 212, the endcap 212 may be used to join adjacent light elements as described above in relation to endcap 112. While shown with the recessed portion 250 and cover 260 being generally diamond shaped, it will be appreciated that any size and/or shape of recessed portion 250 and cover 260 may be used to suit the needs of a particular application.

The methods, systems, and devices discussed above are examples. Some embodiments were described as processes depicted as flow diagrams or block diagrams. Although each may describe the operations as a sequential process, many of the operations can be performed in parallel or concurrently.

In addition, the order of the operations may be rearranged. A process may have additional steps not included in the figure.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

What is claimed is:

1. An alignment system for a linear light fixture, comprising:

a first light element having a first top surface that defines a first top channel, the first light element comprising:

a first endcap that defines a first number of apertures that extend through an entire thickness of the first endcap, a top surface of the first endcap defining a first endcap channel;

a second light element having a second top surface that defines a second top channel, the second light element comprising:

a second endcap that defines a second number of apertures that extend through an entire thickness of the second endcap, a top surface of the second endcap defining a second endcap channel;

a hanger insert that is configured to be positioned between the first endcap and the second endcap, the hanger insert defining a third number of apertures, wherein:

a top surface of the hanger insert defines a hanger insert channel and a hanger connection; and the first channel, the first endcap channel, the second channel, the second endcap channel, and the hanger insert channel form an elongate channel;

a plurality of pins that are configured to extend through the first number of apertures, the second number of apertures, and the third number of apertures; and a connector plate that is configured to be received and secured within the elongate channel, the connector plate defining a central aperture that is configured to provide access to the hanger connection.

2. The alignment system for a linear light fixture of claim 1, wherein:

a face of each of the first endcap and the second endcap comprises a first alignment feature;

each face of the hanger insert comprises a second alignment feature; and the first alignment features are configured to engage with the second alignment features.

3. The alignment system for a linear light fixture of claim 2, wherein:

the first alignment features comprise protrusions that extend outward from the major face of each of the first endcap and the second endcap; and the second alignment features comprise recesses formed within the major faces of the hanger insert.

4. The alignment system for a linear light fixture of claim 1, wherein:

the connector plate has a width that substantially matches a width of the channel.

5. The alignment system for a linear light fixture of claim 1, wherein:

each of the plurality of pins comprises at least one protrusion that extends outward from an outer surface of the pin to limit an insertion depth of the pin within one of the first number of apertures or one of the second number of apertures.

6. The alignment system for a linear light fixture of claim 1, wherein:

the first top channel and the second top channel each define at least one longitudinal slot;

a bottom surface of the connector plate comprises at least one fin; and the at least one fin is insertable within the at least one longitudinal slot to align the first light element and the second light element and prevent the first light element and the second light element from sliding apart.

7. The alignment system for a linear light fixture of claim 1, wherein:

the hanger connection comprises a threaded receptacle that is configured to interface with a corresponding threaded connector of a hanging mechanism to secure the first light element and the second light element to an overhead structure.

8. An alignment system for a linear light fixture, comprising:

a first light element having a first top surface that defines a first top channel, the first light element defining a first number of receptacles;

a second light element having a second top surface that defines a second top channel, the second light element defining a second number of receptacles;

a hanger insert that is configured to be positioned between the first light element and the second light element, the hanger insert defining a number of apertures, wherein:

a top surface of the hanger insert defines a hanger insert channel and a hanger connection; and the first top channel, the second top channel, and the hanger insert channel form an elongate channel;

a plurality of pins that are configured to extend through the number of apertures and into both the first number of receptacles and the second number of receptacles; and a connector plate that is configured to be received and secured within the elongate channel, the connector plate defining a central aperture that is configured to provide access to the hanger connection.

9. The alignment system for a linear light fixture of claim 8, wherein:

the connector plate is secured within the elongate channel using a plurality of fasteners.

10. The alignment system for a linear light fixture of claim 9, wherein:

the plurality of fasteners comprise self-threading screws.

11. The alignment system for a linear light fixture of claim 9, wherein:

the first top channel and the second top channel each define at least one longitudinal slot; and the plurality of fasteners are configured to engage with the at least one longitudinal slot.

12. The alignment system for a linear light fixture of claim 8, wherein:

the connector plate further defines a slot that extends from the central aperture through a peripheral edge of the connector plate.

13. The alignment system for a linear light fixture of claim 8, wherein:

each of the number of apertures has a non-circular cross-section.

14. The alignment system for a linear light fixture of claim 8, wherein:

the hanger connection comprises a protrusion that extends upward from a bottom surface of the hanger insert channel; and the central aperture of the connector plate is configured to receive the protrusion.

15. A method of installing a linear light fixture, comprising:

positioning a hanger insert adjacent to a first endcap of a first light element such that a first aperture defined by the first endcap is aligned with a second aperture defined by the hanger insert;

inserting a pin through the first aperture and the second aperture;

positioning a second endcap of a second light element adjacent to the hanger insert on a side opposite of the first endcap such that a third aperture defined by the second endcap receives an end of the pin;

securing a hanging mechanism to a hanger connection positioned on a top surface of the hanger insert; and securing a connector plate within a channel formed within the top surfaces of the first light element, the first endcap, the hanger insert, the second endcap, and the second light element.

16. The method of installing a linear light fixture of claim 15, wherein:

positioning the hanger insert adjacent to the first endcap comprises engaging an alignment feature of the first endcap with a corresponding alignment feature of the hanger insert.

17. The method of installing a linear light fixture of claim 15, further comprising:

inserting a portion of the hanging mechanism through a slot formed in the connector plate to align a central aperture of the connector plate with the hanger connection prior to securing the connector plate within the channel.

18. The method of installing a linear light fixture of claim 17, wherein:

securing the connector plate within the channel comprises positioning the central aperture of the connector plate around the hanger connection.

19. The method of installing a linear light fixture of claim 15, wherein:

securing the hanging mechanism to the hanger connection comprises engaging a threaded connector of the hanging mechanism with a corresponding threaded feature of the hanger connection.

20. The method of installing a linear light fixture of claim 15, wherein:

securing the connector plate within the channel comprises inserting a plurality of fasteners into the connector plate and the channel.

* * * * *